US007029105B2

(12) United States Patent
Matsuba et al.

(10) Patent No.: US 7,029,105 B2
(45) Date of Patent: Apr. 18, 2006

(54) INK-JET RECORDING DEVICE AND CONTROL METHOD THEREOF

(75) Inventors: Hiroyuki Matsuba, Ohnojo (JP); Hiroyuki Ogata, Chikushino (JP); Yoshinobu Ishimoto, Ohnojo (JP); Tetsuya Matsuzaki, Fukuoka (JP); Masaharu Tanaka, Maebaru (JP); Takashi Yoshihara, Fukuoka (JP); Tadashi Maki, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 433 days.

(21) Appl. No.: 10/367,374

(22) Filed: Feb. 13, 2003

(65) Prior Publication Data

US 2003/0156172 A1 Aug. 21, 2003

(30) Foreign Application Priority Data

Feb. 15, 2002 (JP) ..... P. 2002-038122
Feb. 25, 2002 (JP) ..... P. 2002-047432
Feb. 25, 2002 (JP) ..... P. 2002-047433

(51) Int. Cl.
*B41J 2/175* (2006.01)

(52) U.S. Cl. ..... 347/86
(58) Field of Classification Search ..... 347/86; 346/134; 400/624, 625, 691
See application file for complete search history.

(56) References Cited

U.S. PATENT DOCUMENTS

| | | | |
|---|---|---|---|
| 4,698,650 | A | 10/1987 | Watanabe et al. |
| 6,276,852 | B1 | 8/2001 | Osmus |
| 6,296,407 | B1 | 10/2001 | McKay et al. |
| 6,340,256 | B1 | 1/2002 | McKay et al. |

FOREIGN PATENT DOCUMENTS

| | | |
|---|---|---|
| JP | 60-206688 | 10/1985 |
| JP | 2001-162833 | 6/2001 |
| JP | 2001-191613 | 7/2001 |
| JP | 2001-213019 | 8/2001 |
| JP | 2001-219620 | 8/2001 |
| JP | 2001-322333 | 11/2001 |
| JP | 2002-059564 | 2/2002 |

*Primary Examiner*—K. Feggins
(74) *Attorney, Agent, or Firm*—Pearne & Gordon LLP

(57) ABSTRACT

An ink-jet recording device according to the present invention includes: a paper supply tray arranged inward of a predetermined face of a main body to supply recording sheets; a paper display tray arranged inward of the same face as the paper supply tray to receive recording sheets discharged after recording; an ink cartridge loading unit, which is arranged inward of the same face as the paper supply tray, and into which an ink cartridge containing ink used for recording is loaded detachably; and a controller which disables removal of the ink cartridge during a removal inhibited period.

9 Claims, 38 Drawing Sheets

INK-JET RECORDING DEVICE AND CONTROL METHOD THEREOF

BACKGROUND OF THE INVENTION

1. Field of the Invention

The present invention relates to an ink-jet recording device and to a control method thereof, and relates in particular to an effective technique used for controlling the removal of an ink supply member within which ink used for recording is retained, to an effective technique used for the attachment of a waste ink reservoir in which waste ink is stored, and to an effective technique used for controlling the removal of a waste ink reservoir wherein waste ink is retained.

2. Description of the Related Art

While taking into account the use in living rooms of ink-jet recording devices, a thin and stackable printer has been proposed for which both the detachment of an ink cartridge (ink supply member) and the supply and discharge of recording sheets (recording media) are performed from the front of the device.

A ink-jet recording device in the related art will now be described. FIG. 40 is a perspective view of the exterior of the ink-jet recording device. FIG. 41 is a schematic perspective view of the internal structure of the ink-jet recording device. FIG. 42 is an exterior perspective view of the ink-jet recording device in FIG. 40 wherein a paper discharge tray has been pulled out. FIG. 43 is an exterior perspective view of the ink-jet recording device in FIG. 40 wherein a paper supply tray has been removed. FIG. 44 is an exterior perspective view of the ink-jet recording device in FIG. 40 wherein the front cover has been opened.

As shown in FIG. 40, in the ink-jet recording device, a paper supply tray (medium supply member) 110 is located at a lower position at the front face of the device, and a paper discharge tray (medium discharge member) 111 is located at an upper position.

As shown in FIG. 41, inside the device a carriage 119, wherein a recording head and ink cartridges (ink supply members) 112 are mounted, is supported by a carriage shaft 120 to allow the carriage to reciprocate in the main scanning direction. A pickup roller (not shown) for the individual feeding of recording sheets 138 from the paper supply tray 110 to a lower path which is a part of a paper transporting path; a feed roller 124 for inverting a recording sheet 138 which is transported along the lower path, and guiding the sheet 138 to an upper path which is also a part of the paper transporting path; a transporting roller 125 for transporting the recording sheet 138 along the paper transporting path; and a discharge roller 126 for discharging the recording sheet 138 to the paper discharge tray 111 after recording has been completed, are sequentially located in the direction in which the recording sheet 138 is transported.

In the ink-jet recording device, a recording sheet 138 extracted from the paper supply tray 110 loaded into the front face of the device is supplied to the lower path, internally inverted, and then guided to the upper path. As the recording sheet 138 passes along the upper path, printing is performed thereon, and then, as shown in FIG. 42, the recording sheet 138 is discharged into the paper discharge tray 111 which has been pulled out at the front face of the device.

As shown in FIG. 43, when the paper supply tray 110 is removed, an opening 139 is obtained at the bottom of the device that facilitates the removal from the lower path of a jammed recording sheet 138. As shown in FIG. 44, by opening a front cover 140, the carriage 119 is exposed, and the ink cartridges 112, which are mounted in the carriage 119, can be easily exchanged.

Example techniques for a thin printer are as follows.

Disclosed in Japanese Patent Publication No.2001-219620 is a thin, stackable printer including: a base chassis assembly having a box shape with a channel member sandwiched between an upper path and a lower path to support, from the bottom, a sheet medium that is moved along the internal path of the printer; and a removable medium cassette assembly, slidably attached along the lower path, for holding the sheets that are individually supplied as input media and that are discharged from the printer as output media, wherein the channel member has a centrally arranged medium access cutout member that is wide enough and long enough to permit a user to access a sheet medium, which is supported by the channel member, when the medium cassette assembly is removed from the lower path.

Also disclosed in Japanese Patent Publication No. 2001-191613 is a thin printer including: a base chassis assembly having an upper path with a satisfactory height, width and depth to allow a sheet medium to be held securely while being moved along a transporting path, and a lower path with a satisfactory height, width and depth to allow a medium cassette which includes an input tray and an output tray to be stored slidably; and a channel member attached between the upper path and the lower path for helping to define a part of the path extending from the input tray to the output tray of the printer, wherein the channel member is constructed with multiple openings, the sizes of which are adequate to permit the easy removal of a jammed medium from the defined portion of the medium path.

Further, disclosed in Japanese Patent Publication No. 2001-213019 is a thin, stackable printer including a base assembly having a housing and a base plate and having a height, width and depth that are substantially suitable for a stackable home center electronic apparatus, wherein the base assembly has a bottom opening, centrally formed, having a height, width and depth that is substantially adequate for the slidable storage of a thin medium cassette constituted by an input tray and an output tray, and wherein the base assembly has a thin recording bar for the easy ejection of ink onto a sheet medium that is transported from the input tray to the output tray.

However, the ink-jet recording device has the following problems.

That is, since the ink cartridges 212 and the carriage 219 thereof are positioned so that the ink cartridges 212 must be attached/detached to/from the front of the device, and since the paper discharge tray 211 to which a recording sheet 238 is discharged after recording must be extended out beyond the front face of the device so that it is positioned forward of the main body, this configuration imposes limitations on the usability and the size of the device.

Further, since the front cover 240 must be opened to exchange the ink cartridge 212, greater simplification of the exchange process is required.

In addition, since the ink cartridge 212 is mounted on the carriage 219, as the volume of the cartridge 212 is increased, the size of the carriage 219 must likewise be increased, and this will prevent an improvement in the recording speed.

In order to resolve these problems, an ink cartridge loading unit (ink supply member loading unit), in addition to the paper supply tray 210 and the paper discharge tray 211, should be provided at the front of the device for the detachable mounting of the ink cartridge 212. With the direct external access afforded by this configuration, the exchange of used and new ink cartridges 212 will be more convenient. And as a result, ink cartridge replacement will be easier to perform.

However, the thus arranged ink-jet recording device has the following problems.

While an ink cartridge can be easily attached/detached to/from the front face of the device, the ink cartridge may erroneously be removed, which in this case may produce the following defective results.

First, when an ink cartridge is removed during a period such as a recording period, while ink is flowing from the ink cartridge to the recording head, air bubbles will enter the ink flow path at the location whereat the ink cartridge and the main body of the device are connected, and an ink ejection malfunction may thereafter occur at the recording head.

Even when an ink cartridge is not removed from the main body while ink is flowing, air bubbles, even though in a smaller amount, may still enter the ink flow path and the ink cartridge at the connection between the main body and the ink cartridge. Thus, when the ink cartridge is again loaded into the main body, a pump must be used to discharge an amount of ink, enough to eliminate the adverse effects produced by the air bubbles, through the nozzles of the recording head. Further, additional time is also required for this discharging operation.

SUMMARY OF THE INVENTION

It is, therefore, one objective of the present invention to provide an ink-jet recording device and a control method thereof that can prevent the entry into an ink flow path of air bubbles when a detachable ink supply member is externally removed.

Further, one objective of the present invention to provide an ink-jet recording apparatus for which the size of a waste ink reservoir is reduced.

Still further, one objective of the present invention to provide an ink-jet recording device that can prevent the leakage of ink inside the device when a detachable waste ink reservoir is externally removed.

According to a first aspect of the present invention, an ink-jet recording device includes: a medium feeding unit, arranged inward of a predetermined face of a main body, for feeding a recording medium; a medium ejection unit, arranged inward of the same face as the medium loading unit, for ejecting the recording medium after recording; an ink supply member loading unit, arranged inward of the same face as the medium loading unit, for detachably loading an ink supply member wherein ink used for recording is retained; and a removal inhibition unit for disabling removal of the ink supply member during a removal inhibited period for the ink supply member, thereby being able to prevent the entry into an ink flow path of air bubbles when a detachable ink supply member is externally removed.

According to a second aspect of the present invention, an ink-jet recording device includes: a medium feeding unit, arranged inward of a predetermined face of a main body, for feeding a recording medium; a medium ejection unit, arranged inward of the same face as the medium loading unit, for ejecting the recording medium after recording; an ink supply member loading unit, arranged inward of the same face as the medium loading unit, for detachably loading an ink supply member wherein ink used for recording is retained; an operation detector for detecting the start of an ink supply member removal operation; and a removal controller for, when during the removal inhibited period the operation detector has detected the start of the ink supply member removal operation, shifting the ink-jet recording device to the recording standby state to enable the removal of the ink supply member, thereby being able to prevent the entry into an ink flow path of air bubbles when a detachable ink supply member is externally removed.

According to a sixth aspect of the present invention, an ink-jet recording device includes: a medium feeding unit, arranged inward of a predetermined face of a main body, for feeding a recording medium; a medium ejection unit, arranged inward of the same face as the medium loading unit, for ejecting the recording medium after recording; an ink supply member loading unit, arranged inward of the same face as the medium loading unit, for detachably loading an ink supply member wherein ink used for recording is retained; a removal detector for detecting removal of the ink supply member; and a removal controller for, when during the removal inhibited period the removal detector detects that the ink supply member has been removed, shifting the ink-jet recording device to the recording standby state, thereby being able to prevent the entry into an ink flow path of air bubbles when a detachable ink supply member is externally removed.

DETAILED DESCRIPTION OF THE PREFERRED EMBODIMENT

Figure 1:
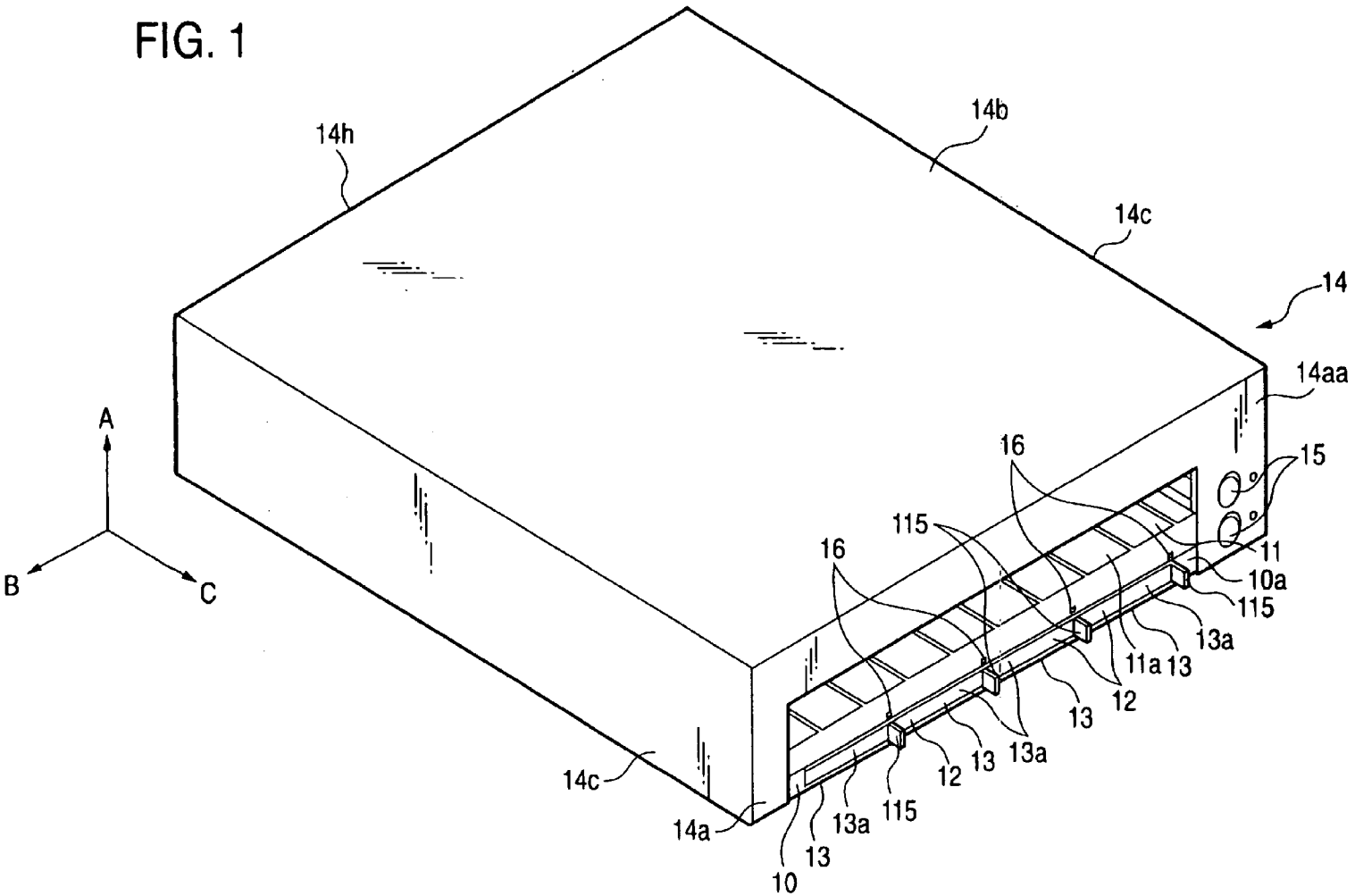
FIG. 1 is a perspective view of the exterior of an ink-jet recording device according to a first embodiment of the present invention.

The embodiments of the present invention will now be described while referring to FIGS. 1 to 39. The same reference numerals are used throughout to indicate corresponding components, and no explanation will be given for the like configurations.

(Embodiment 1)

Figure 2:
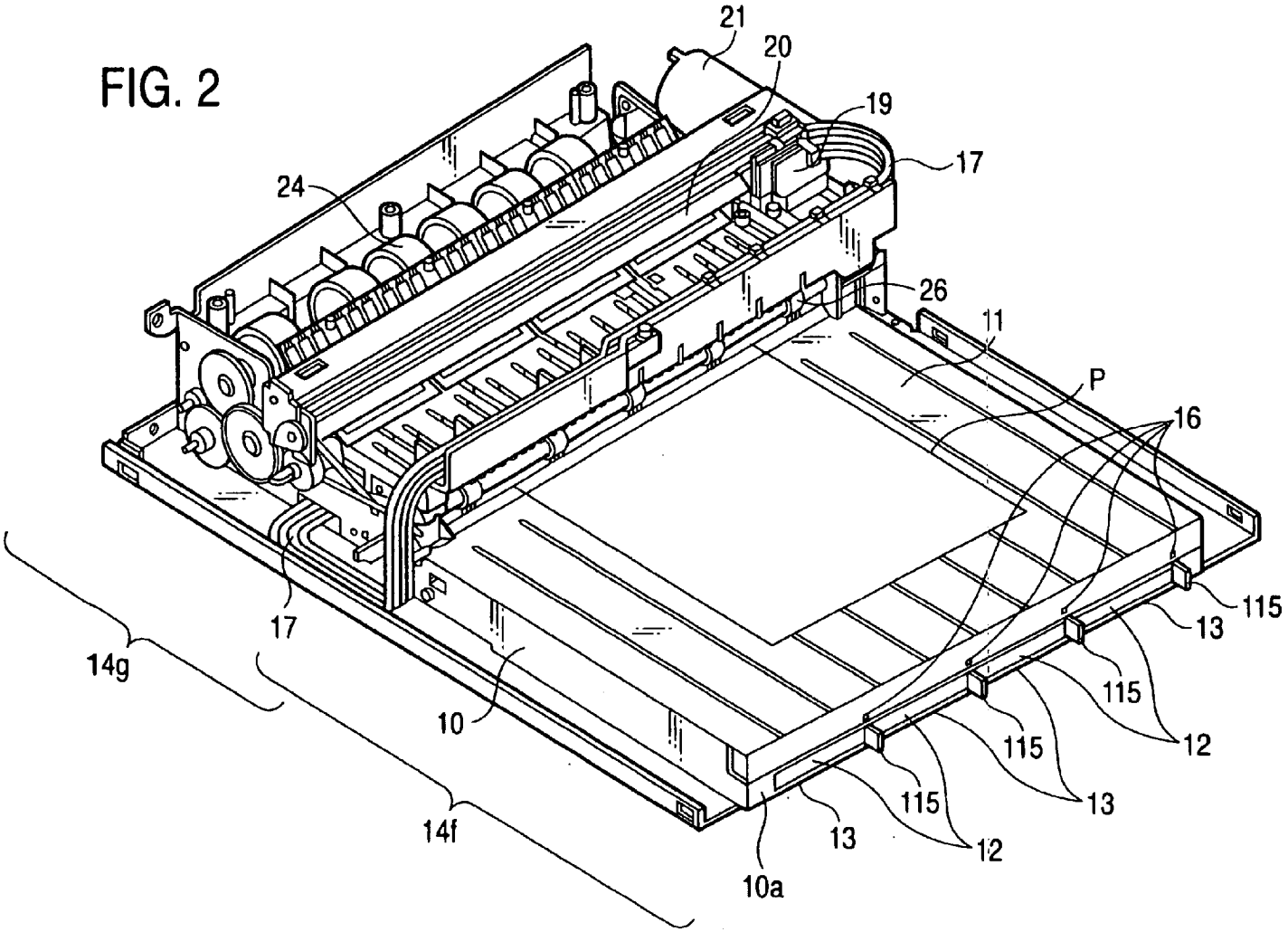
FIG. 2 is a perspective view of the internal structure of the ink-jet recording device in FIG. 1.
Figure 3:
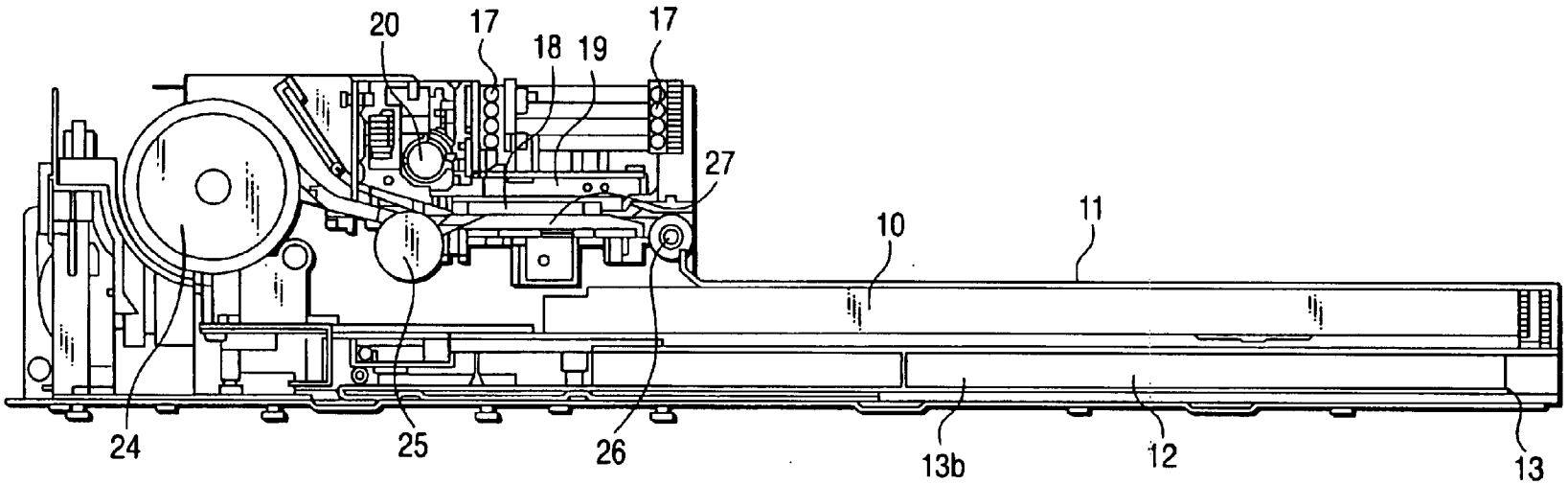
FIG. 3 is a side view of the internal structure of the ink-jet recording device in FIG. 1.
Figure 4:
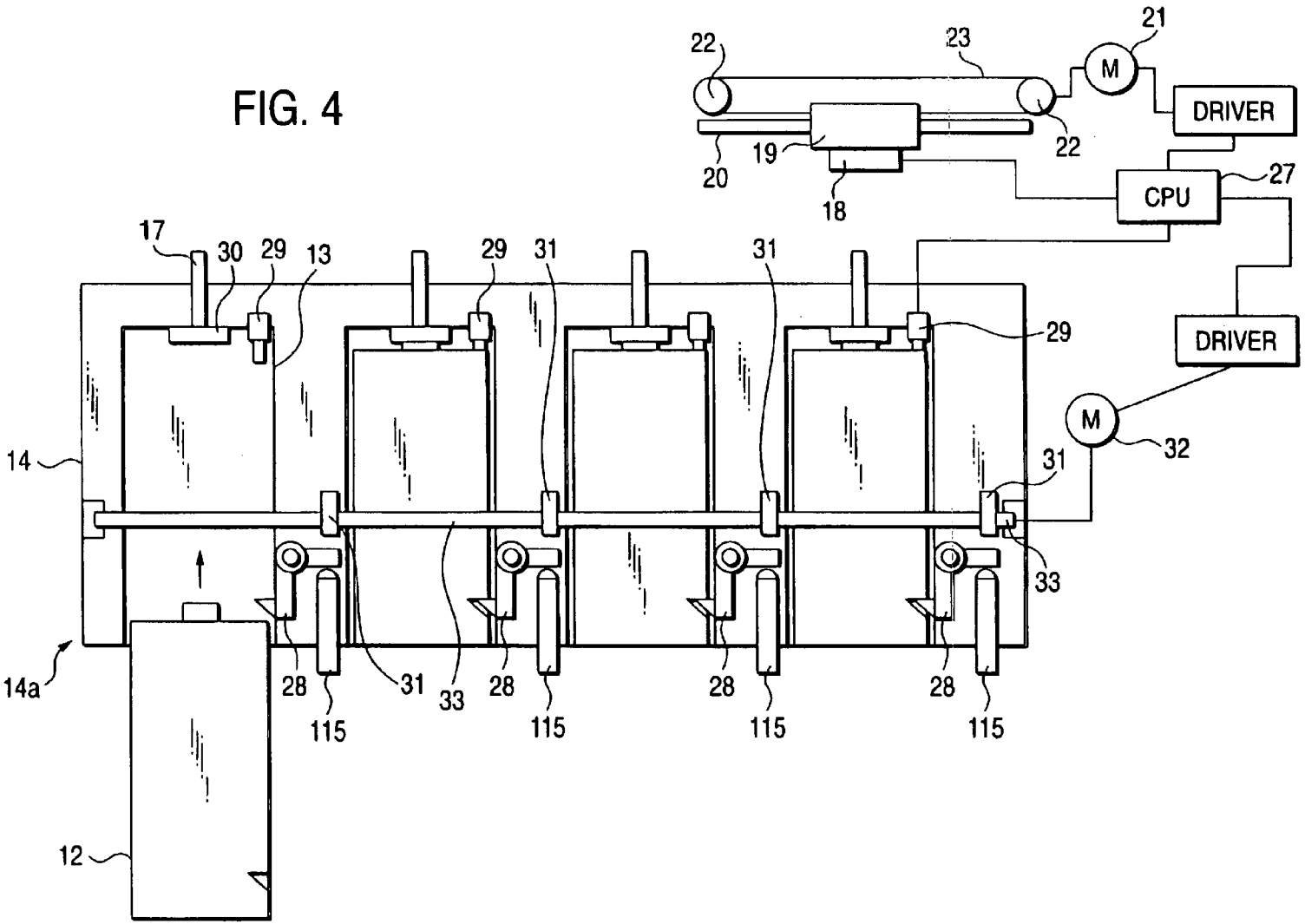
FIG. 4 is an explanatory diagram showing the ink-jet recording device in FIG. 1 wherein a control mechanism has removed an ink cartridge.
Figure 5:
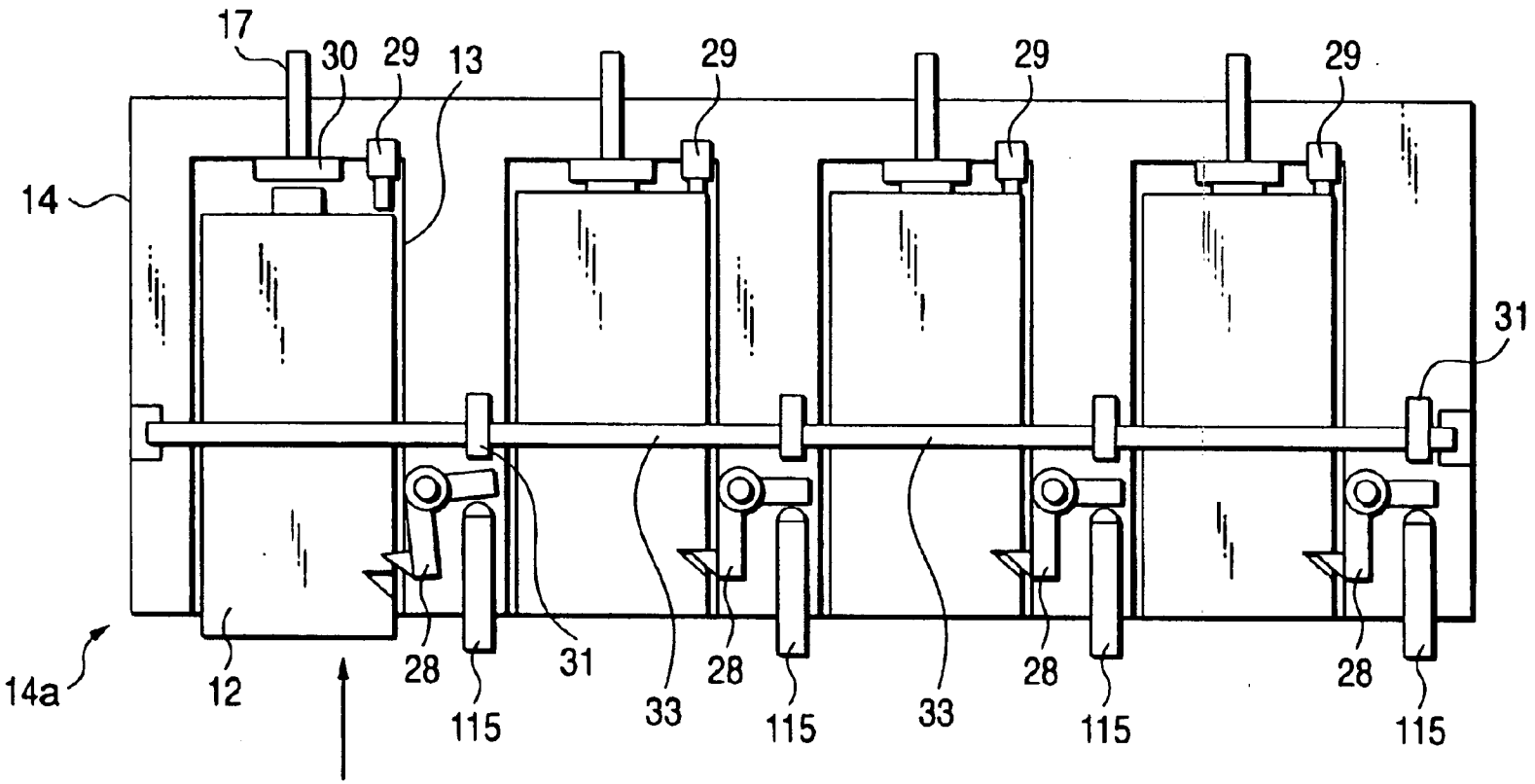
FIG. 5 is an explanatory diagram showing the ink-jet recording device in FIG. 1 wherein the control mechanism is loading an ink cartridge.
Figure 6A:
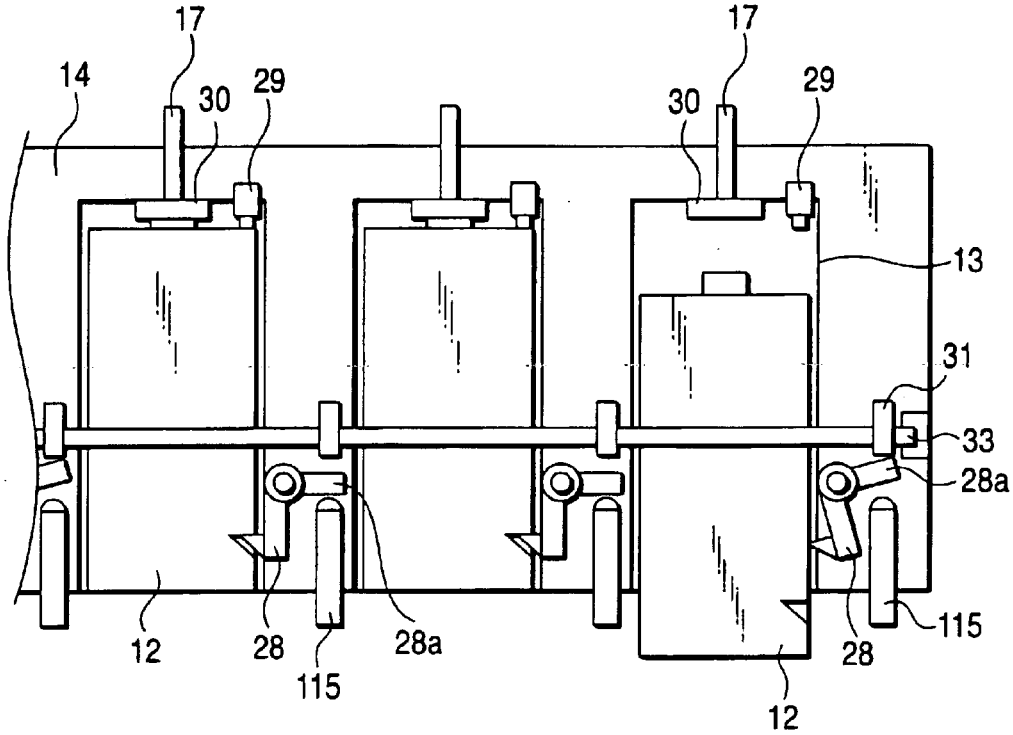
FIGS. 6A to 6C are explanatory diagrams showing the ink-jet recording device in FIG. 1 wherein the control mechanism has loaded the ink cartridge.
Figure 7:
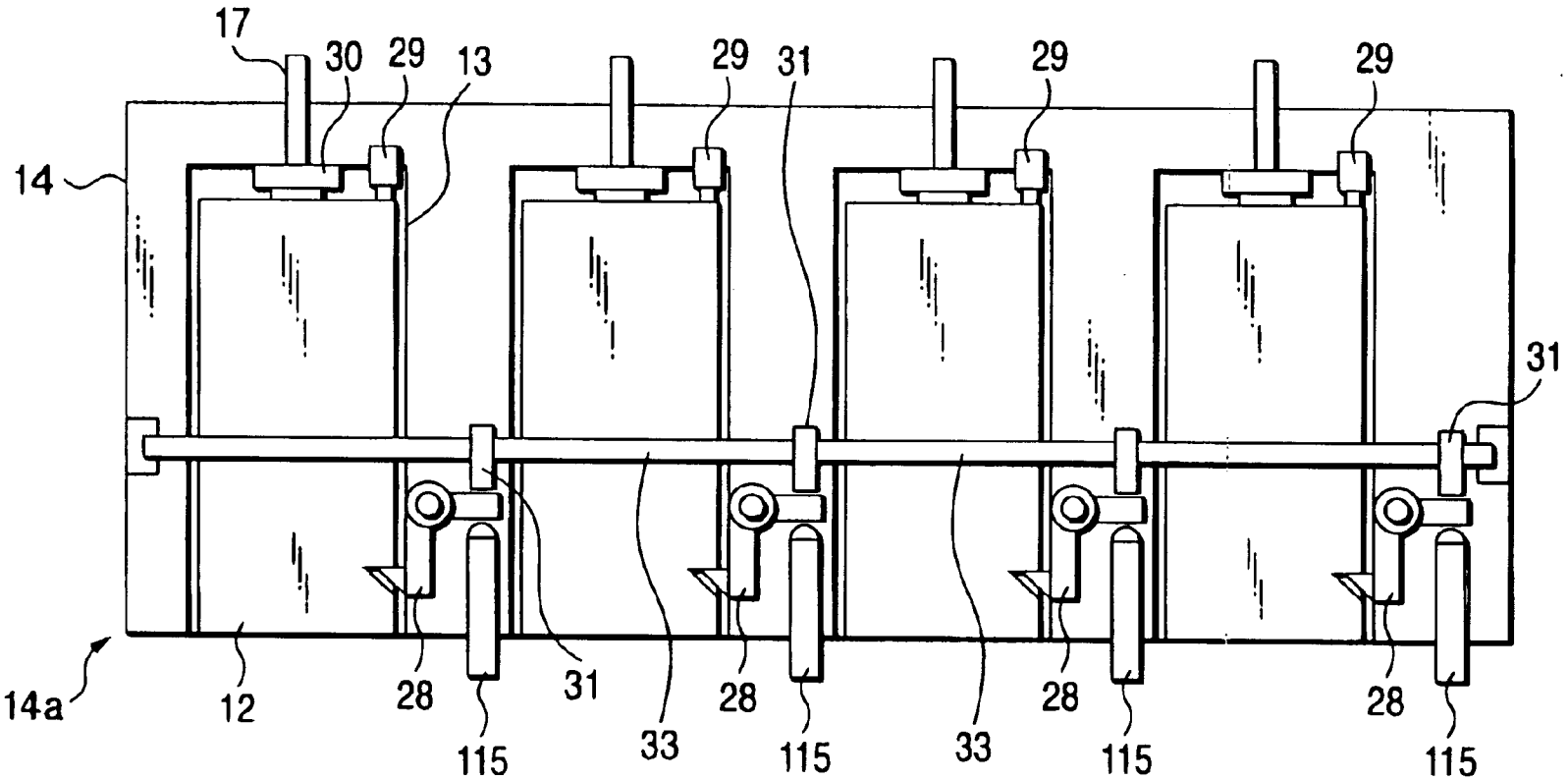
FIG. 7 is an explanatory diagram showing the ink-jet recording device in FIG. 1 wherein the control mechanism disables removal of an ink cartridge.
Figure 8:
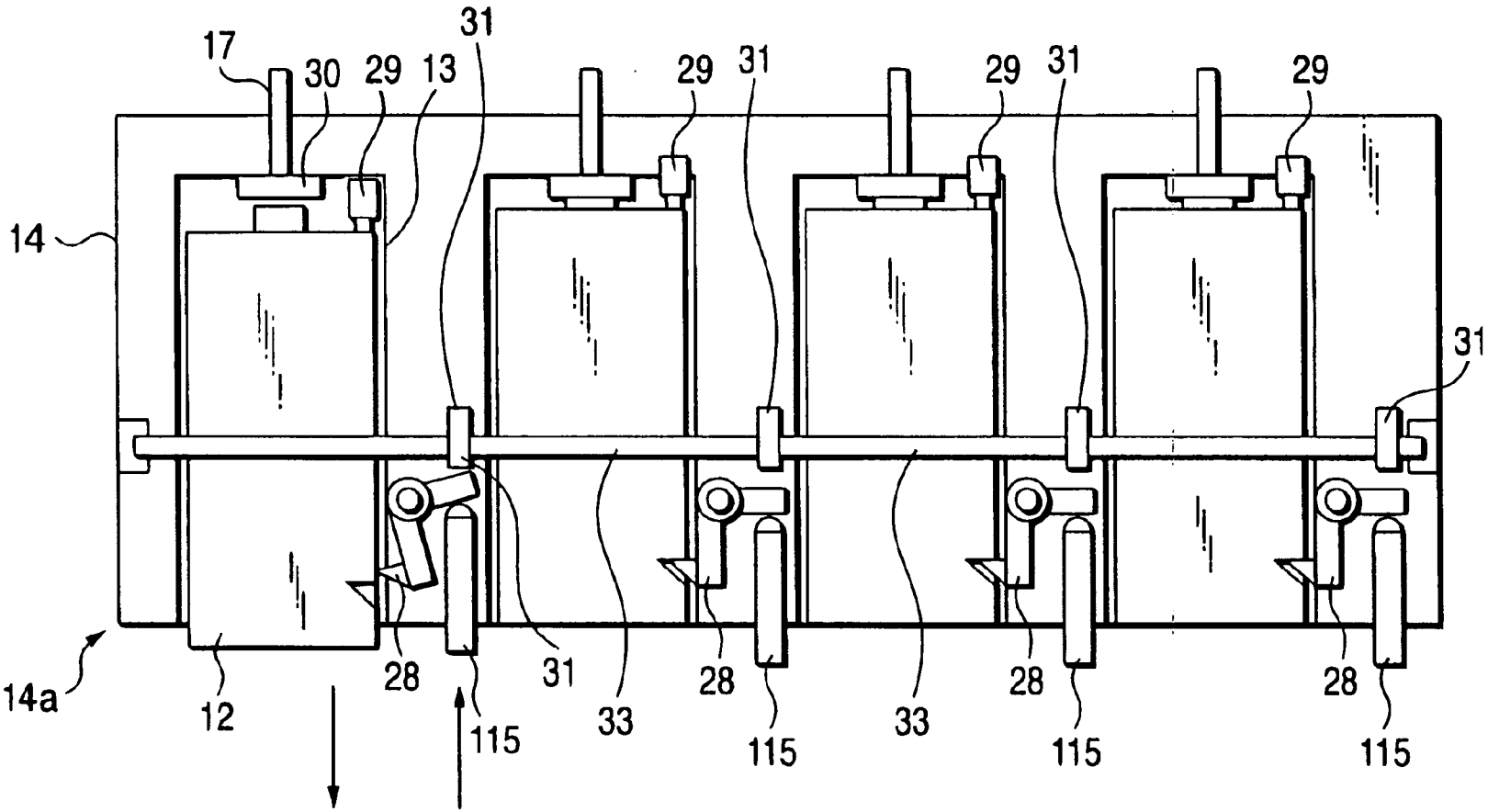
FIG. 8 is an explanatory diagram showing the ink-jet recording device in FIG. 1 wherein the control mechanism enables removal of an ink cartridge.

FIG. 1 is a perspective view of the exterior of an ink-jet recording device according to a first embodiment of the invention. FIG. 2 is a perspective view of the internal structure of the ink-jet recording device in FIG. 1. FIG. 3 is a side view of the internal structure of the ink-jet recording device in FIG. 1. FIG. 4 is an explanatory diagram, showing a control mechanism provide for the ink-jet recording device in FIG. 1, wherein an ink cartridge has been removed. FIG. 5 is an explanatory diagram, showing the control mechanism of the ink-jet recording device in FIG. 1, wherein the loading of the ink cartridge is being performed. FIG. 6 is an explanatory diagram, showing the control mechanism of the ink-jet recording device in FIG. 1, wherein the ink cartridge has been loaded. FIG. 7 is an explanatory diagram, showing the control mechanism of the ink-jet recording device in FIG. 1, wherein removal of the ink cartridge has been disabled. FIG. 8 is an explanatory diagram, showing the control mechanism of the ink-jet recording device in FIG. 8, wherein the removal of the ink cartridge has been enabled.

As shown in FIG. 1, the ink-jet recording device of this embodiment includes: a paper supply tray (medium supply member) 10 provided at substantially the center of a front face 14*a* of a main body 14 in a heightwise direction A for supplying a recording sheet (recording medium) P; a paper discharge tray (medium discharge member) 11, onto which the recording sheet P is discharged after recording; multiple ink cartridge loading units (ink supply member loading units) 13, into which multiple (four, in this embodiment, for the colors black, cyan, magenta and yellow) ink cartridges (ink supply members) 12 are detachably loaded, all of these components are provided toward the inside of the main body 14.

It is preferable that the paper supply tray 10, the paper discharge tray 11, the ink cartridges 12 and the ink cartridge loading units 13 are mounted substantially in the same direction because this affords the greatest reduction in the thickness of the main body 14. It is especially preferable that these members are mounted substantially vertically (almost parallel to a plane defined by the heightwise direction A and the widthwise direction B) because this arrangement provides the greatest effects for the reduction in the thickness of the main body 14. For mounting the members in the same direction, the angles formed by individual members need only be ±10° or smaller. Similarly, for mounting the members vertically, the angles formed by the individual members need only be ±10° or smaller, relative to the vertical direction.

The ink cartridge loading units 13 include, for the respective ink cartridges 12, an opening 13*a* formed in the front face 14*a* of the main body 14, a space 13*b* defined inside the main body 14, and a connector (not shown) for connecting the ink cartridge 12 to the main body 14 by using liquid.

The spaces 13*b* in which the ink cartridges 12 are inserted are arranged in the widthwise direction of the main body 14, and the shapes of the inserted ink cartridges 12 have a substantially rectangular parallelepiped shape having the longer edges in the order in the depthwise direction C, the widthwise direction B and the heightwise direction A. With this configuration, the size of the main body 14 in the heightwise direction is reduced, and as a result, the overall height of the device is reduced. Therefore, the strength of side walls 14*c* of the main body 14, which becomes a problem when objects are mounted on a top face 14*b* of the main body 14, can be increased, so that the permitted load value of the main body 14 can be increased and the space can be more effectively employed. Further, since the size of the ink cartridge 12 in the vertical direction can be reduced, back pressure fluctuation, which is caused by the shifting of the surface level of ink as its volume is being reduced, can be minimized, and a stable ink supply system can be implemented.

In this embodiment, the ink cartridge loading units 13 define the individual spaces 13*b* for the respective ink cartridges 12. Multiple (e.g., two or four) ink cartridges maybe held in one space 13*b*. In this embodiment, all the (four) ink cartridges 12 are arranged in the widthwise direction B; however, the ink cartridges 12 may be formed so that their size is greater in the heightwise direction A and they are narrower in the widthwise direction B, and a plurality (e.g., each two or all four) of ink cartridges 12 may be stacked in the heightwise direction A.

Through direct external access of the main body 14, a user can remove an ink cartridge 12 from the main body 14, and can attach a new ink cartridge 12 to complete an exchange of ink cartridges 12.

In this embodiment, black, cyan, magenta and yellow inks are retained in the ink cartridges 12. To improve the image quality, cartridges for what is generally called photoink, such as light cyan, light magenta and dark yellow, may be further provided. In this case, in accordance with the number of ink colors to be used, six or seven spaces 13*b* are provided for the individual cartridges 12. Further, in accordance with the amount of ink to be consumed, the ink cartridge for black ink maybe larger than the ink cartridges for other colors, or color ink cartridges may be provided as a single cartridge unit.

Operating switches (operating system) 15 for operating the ink-jet recording device are arranged on the side portion 14*aa* of the front face 14*a* where the ink cartridge loading units 13 are formed. Instead of being located on the front face 14*a* where the ink cartridge loading units 13 are arranged, the operating switches 15 may be formed on another face so long as the face is exposed and faces in the same direction as the front face 14*a*. That is, the operating switches 15 may be located anywhere so long as a user can operate them from the front.

When the operating switches 15 are arranged on the front face 14*a* of the main body 14 in this manner, a user friendly ink-jet recording device can be provided that a user can operate more easily than one for which the operating switches 15 are arranged on the top face 14*b* or the side face 14*c*. Further, an object can be placed on the top face 14*b* or near the side faces 14*c*, i.e., the peripheral space surrounding the main body can be employed more effectively.

In FIG. 1, the front face 14*a* is perpendicular to the plane defined in the directions A and C, and the side portions 14*aa* are also perpendicular. However, this angle need not be a right angle, and may be smaller (inclined greatly away from the user). Further, the individual faces need not be flat, and may be complicatedly curved. When the front face 14*a* is inclined relative to the perpendicular direction, the size of the front face 14*a* can be increased, and accordingly, the sizes of the operating switches 15 and the number provided on the front face 14*a* can be increased. Thus, the usability of the device can be improved. In this embodiment, only the operating switches 15 for the operating system are shown; however, a display device, such as a liquid crystal display or an LED, or a touch panel, or an insertion slot for a semiconductor memory may also be provided. The connectors for connecting the PC and the STB may also be provided on the front face 14*a*; however, it is preferable, for appearances sake, that the connectors be provided on a rear face 14*h* because connection cords will be hidden from the user.

In substantially the same direction, the recording medium is fed from (or supplied to) the paper supply tray 10, the recording medium after recording is discharged from (or discharged to) the paper discharge tray 11, and an ink cartridge 12 is ejected from (or loaded into) the ink cartridge loading unit 13. Incidentally, "Substantially the same direction" means that the main components of the vectors representing the input or output direction are the same. In this embodiment, even when some vector components are present in the heightwise direction A and the widthwise direction B, the main component is in the depthwise direction C.

With this configuration, for maintenance, a user's access of the device is performed in only one direction, and a very usable ink-jet recording device can be provided. Especially since the cover formed over multiple faces (e.g., the front face 14*a* and the top face 14*b*) of the device need not be opened to exchange ink cartridges, superior maintenance can be ensured, and before exchanging ink cartridges, less arranging of objects around the periphery (especially on the top face) of the device is required.

In this embodiment, the trays are employed to mount the recording media. However, a cassette, detachable from the main body of the device, may be employed. Further, when a slot for a semiconductor memory is provided, the detachment direction is preferably the same as that described above.

In the configuration of the ink-jet recording device manipulated in a direction from a specific plane (the front face 14*a*), shown especially in FIG. 2, it is preferable that, viewed from the specific plane (the front face 14*a*), the members used for operations or for maintenance, such as the paper supply tray 10, the paper discharge tray 11, the ink cartridges 12, the ink cartridge loading units 13 and the operating switches 15, are arranged on a front portion 14*f* of the main body 14. It is also preferable that mechanisms for transporting a recording medium, for a recording head and for a carriage and, where required, for a carriage driving system for serial recording, are arranged in a rear portion 14*g*. With this configuration, the thickness of the main body 14 can be greatly reduced, and a user can easily supplement the ink or the recording media (the supplementation of ink is especially easier). As a result, an ink-jet recording device can be provided for which superior maintenance is ensured. Further, the front portion 14*f* and the rear portion 14*g* need not be strictly defined by partitions, and may partially coexist within the main body 14.

In this embodiment, the paper supply tray 10, the paper discharge tray 11 and the ink cartridge loading units 13 are arranged so they can be accessed from the front face 14*a*. According to the invention, however, these components need only be arranged so they can be accessed from the same face of the main body 14, and need not always be provided on the front face 14*a*.

It is preferable that the top face 14*b* of the main body 14 is as flat as possible because documents or files can then be easily displayed on the top face 14*b*. While taking into account the stacking of electronic products, such as an audio deck and a video deck, that are frequently seen in living rooms, it is preferable that the portions (generally the four corners of the main body) corresponding to the legs of these products have substantially the same height because the products can then be stacked stably. In this case, so long as the four corners are at the same height, the other portions need not have the same height. The shape shown in FIG. 1, or another structure for which projections are formed only at the four corners may be employed. Further, it is preferable that greater reinforcement is provided for weight bearing portions, which can support multiple stacked devices, than for other portions. It is also preferable that the reinforced portions are identified for a user, because the breaking of the main body 14 due to incorrect use can then be prevented. To identify the reinforced positions, either marks may be provided on the main body 14, or written instructions may be included in manuals.

As for the positional relationship of the ink cartridges 12 (the ink cartridge loading units 13), the paper ink tray and the paper discharge tray 11, the ink cartridges 12, the paper supply tray 10 and the paper discharge tray 11 are stacked in the named order in the heightwise direction A.

As described above, since the ink cartridge loading units 13 are provided below the paper supply tray 10, the smearing of ink on a new recording sheet P can be prevented when ink cartridges 12 are exchanged. Further, since the ink cartridge loading units 13 are provided below the paper discharge tray 11, the smearing of ink on a recording sheet P after recording can be prevented when the ink cartridges 12 are exchanged. Further, since the paper supply tray 10 is provided under the paper discharge tray 11, the recording sheet P can be consistently transported, with the recording face up, even when it is inverted by feed rollers 24. Therefore, the smearing of the recording face can be suppressed and the recording of data can be promptly confirmed. Furthermore, with this configuration, the ink cartridges 12 can be exchanged without them having to be passed over the paper supply tray 10 and the paper discharge tray 11. Thus, an ink-jet recording device 12 can be provided for which there is very little possibility that ink will be smeared on the recording sheets P, either before and after recording, and for which maintenance can be easily performed.

Since the ink cartridges 12 (inserted into the openings 13*a* of the ink cartridge loading units 13), a face 10*a* of the paper supply tray 10 near the front face 14*a* and an opening 11*a* of the paper discharge tray 11 are arranged on the same plane, a user can easily perform a maintenance operation, such as the supplementation and extraction of recording media and the exchange of the ink cartridges 12.

The arrangement on the same plane is the range within which a user can easily perform a maintenance operation. More specifically, so long as the trays 10 and 11 and the ink cartridges 12 are within a range (about three to four cm or smaller, though in individual cases this may differ) wherein a user can use his or her fingers to manipulate parts during a maintenance operation, the operation can be satisfactorily performed, even when another apparatus, such as an audio deck or a video deck, is mounted on the main body 14 of the device.

In addition, since most of the components, such as the operating switches 15, required for an operation performed by a user are arranged near the surface (or more specifically, on the same plane) of the main body and near the front face 14*a*, a more usable ink-jet recording device can be provided with which space can be employed more effectively.

In this embodiment, ink cartridges 12 containing yellow, magenta, cyan and black ink are loaded, and eject buttons (switching portions) 115, provided beside the ink cartridges 12, are used to extract the ink cartridges 12 so that they project outward and can be removed from the ink cartridge loading unit 13.

Above the ink cartridges 12, LEDs (notification devices) 16 are provided that turn green when the ink cartridges 12 are loaded in the ink cartridge loading units 13, and that turn red when the ink cartridges 12 are not loaded. The notification devices need not be the LEDs 16, and may notify the user of either the state where the ink cartridges 12 are loaded, or the state where they are not loaded. In addition, for controlling the ink-jet recording device, instead of a notification device being provided for the ink-jet recording device, one may be provided for the monitor of an apparatus, such as a personal computer or a remote controller.

In this embodiment, the paper supply tray 10, the paper discharge tray 11 and the ink cartridge loading units 13 are so arranged that they can be accessed from the front face 14*a* of the device. However, these components need not always be arranged so they can be accessed from the front face 14*a*, but may instead be arranged so that all of them can be accessed from another face of the main body 14.

As shown in FIGS. 2 and 3, a carriage 19, wherein a recording head 18 is provided to which ink from the ink cartridge 12 is supplied through a tube 17, is supported by a carriage shaft 20 and is reciprocally driven, in the main direction, by a carriage motor 21. As will be described later while referring to FIG. 4, the carriage 19 is fixed to a belt 23 that is pulled around a pair of pulleys 22, and when the rotational force of the carriage motor 21 is transmitted to one of the pulleys 22, the belt 23 is rotated and the carriage 19 is driven reciprocally. In addition, a pickup roller (not shown) for individually feeding the recording sheets from the paper supply tray 10 to the lower path, which is part of a sheet transporting path; the feed rollers 24, for inverting the recording sheet on the lower path and guiding the inverted sheet to the upper path, which is another part of the sheet transporting path; a transporting roller 25 for transporting the recording sheet along the sheet transporting path; and a discharge roller 26 for discharging the recording sheet, after recording, to the paper discharge tray 11 are arranged in the named order in the direction in which the recording sheet is transported.

The tube 17, together with a cable along which a head drive signal is transmitted from a drive signal generator to the recording head 18, is located so that the transporting of the recording sheet and the movement of the carriage 19 are not interfered with.

In this ink-jet recording device, a recording sheet, individually fed to the lower path from the paper supply tray 10 loaded at the front face 14*a*, is inverted by the feed rollers 24 located at the rear portion of the device, the inverted recording sheet is then guided to the upper path and is printed on a platen while being passed along the upper path, and the resultant recording sheet is discharged to the paper discharge tray 11. After recording, the recording sheet is removed by directly accessing the paper discharge tray 11 from the front face 14*a*.

It is not appropriate for the ink cartridge 12 to be removed during a period (removal inhibited period) in which air bubbles would enter the ink flow path as the ink cartridge 12 is being removed from the ink cartridge loading unit 13, such as during the performance of a recording operation or a head function recovery operation (an operation for removing from the recording head 18 residual ink, dust or air bubbles and for recovering the ink ejection function, such as an operation during which a pump is used to suck ink from the nozzles of the recording head 18 and to clean the recording head 18, or an operation during which viscous ink attached near around the nozzles of the recording head 18 is forcibly ejected and ink having appropriate viscosity is introduced into the nozzles). When air bubbles have entered the ink flow path from the portion whereat the ink cartridge 12 is coupled with the main body 14, an ink ejection malfunction will occur at the recording head 18, and in order to resume normal ink ejection, the air bubbles must be removed by ejecting a predetermined amount of ink through the nozzles of the recording head 18.

The removal inhibited period is not limited to the recording period and the head function recovery period, other periods may also be included. That is, the removal inhibited period is a period during which air bubbles may enter the ink flow path by removing the ink cartridge 12. The removal inhibited period includes not only a period, such as a recording period, wherein ink flows from the ink cartridge 12 to the recording head 18, but also a period wherein, although there is no ink flow, air bubbles enter the ink flow path when the ink cartridge 12 is removed from the main body 14. The removal inhibited period does not always include all periods wherein air bubbles enter the ink flow path when the ink cartridge 12 is removed, but it includes at least one of these periods. Therefore, the removal inhibited period may be either a recording period or a head function recovery period.

As shown in FIGS. 4 to 8, the ink-jet recording device of this embodiment further includes a controller (removal inhibition unit) 27 for disabling the removal of the ink cartridge 12 during a removal inhibited period. The controller 27 prevents air bubbles from entering the ink flow path due to the removal of the ink cartridge 12, which can be directly unmounted, externally.

As shown in FIGS. 4 to 8, the ink-jet recording device further includes: holding hooks (holding members) 28 for engaging the side faces of mounted ink cartridges 12 and holding the ink cartridges 12 in the ink cartridge loading units 13; eject buttons 115 for displacing the holding hooks 28 and disengaging the holding hooks 28 from the ink cartridges 21, and for enabling the removal of the ink cartridges 12 from the ink cartridge loading unit 13 by projecting the ink cartridges 12; detection switches 29 for detecting the loading of ink cartridges 12 in the ink cartridge loading units 13; and cartridge connectors 30 for connecting the tubes 17 of the main body 14 to the ink cartridges 12 and for enabling the introduction into the tubes 17 of ink from the ink cartridges 12.

The ink-jet recording device further includes: a lock shaft 33, which is rotated by a motor 32 and to which lock levers (removal prevention device) 31, corresponding to the holding hooks 28, are attached. As the lock shaft 33 is rotated, the lock levers 31 are displaced between a first position and a second position. At the first position, the displacement range of the holding hooks 28 is limited to prevent the ink cartridge 12 from being projected by an eject button 115, and at the second position, the displacement range of the holding hooks 28 is reserved to allow the ink cartridge 12 to be projected by the ejection button 115.

The controller 27 rotates the lock shaft 33 through a driver, and maintains the lock levers 31 at the first position during a removal inhibited period, or at the second position during a period other than the removal inhibited period.

The operation of the thus arranged ink-jet recording device will now be described.

As shown in FIG. 4, the controller 27 rotates the lock shaft 33 to displace the lock levers 31 to the second position, and an ink cartridge 12 is inserted into the ink cartridge loading unit 13 in the main body 14. Then, as shown in FIG. 5, the holding hook 28, which is urged clockwise by a spring (not shown), is rotated counterclockwise. Then, when the ink cartridge 12 has been inserted until it is coupled with the cartridge connector 30, the holding hook 28 is fitted into a groove formed in the side face of the ink cartridge 12 to maintain the coupling of the ink cartridge 12 and the cartridge connector 30. As a result, ink in the ink cartridge 12 can be supplied through the tube 17 to the recording head 18 (FIG. 6A).

Figure 6B:
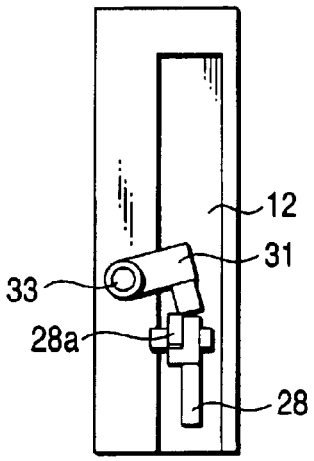
Figure 6C:
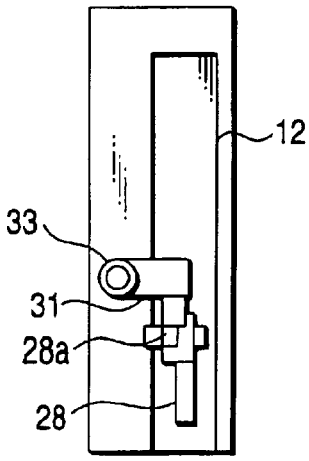

Thereafter, during a removal inhibited period, such as a recording period or a head function recovery period, as the lock shaft 33 is rotated by the motor 32, controlled by the controller 27, the lock lever 31 provided on the lock shaft 33 is displaced from the second position in FIG. 6B to the first position in FIG. 6C. As shown in FIG. 7, since at the first position the range available for displacing the holding hook 28 is limited by the lock lever 31, the ink cartridge 12 can not be projected, even when the eject button 115 is manipulated. That is, at the first position in FIG. 6C, a lever 28*a* of the holding hook 28 abuts on the lock lever 31 and as a result, displacement of the holding hook 28 is inhibited.

During a period other than a removal inhibited period, since the lock shaft 33 is rotated by the controller 27 and the lock lever 31 is displaced to the second position, as shown in FIG. 8, the range available is adequate and the holding hook 28 can be displaced. Therefore, the holding hook 28 can be rotated counterclockwise by depressing the eject button 115, and disengaged from the side face of the ink cartridge 12. Then, the ink cartridge 12 can be projected and removed.

As described above, according to the present invention, in the ink-jet recording device wherein the ink cartridge 12 can be accessed easily even during operation (e.g., the ink cartridge 12 can be accessed without opening the cover, which opens toward the internal area of the device wherein the carriage is moved), the controller 27 disables removal of the ink cartridge 12 during a removal inhibited period. Therefore, air bubbles can be prevented from entering the ink flow path due to the removal of the ink cartridge which can be directly detachable, externally.

(Embodiment 2)

Figure 9:
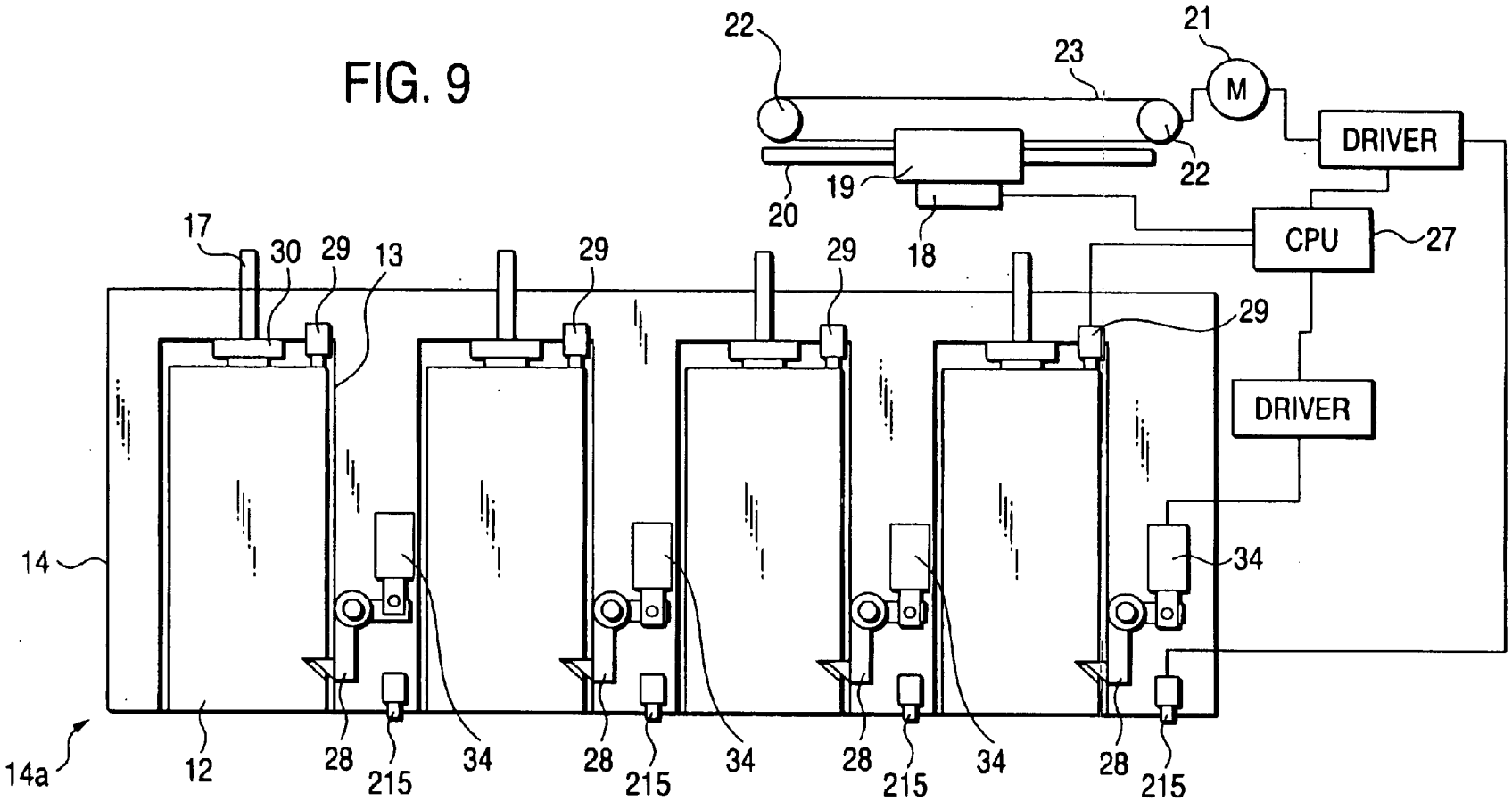
FIG. 9 is an explanatory diagram showing an ink-jet recording device according to a second embodiment of the present invention wherein a control mechanism disables removal of an ink cartridge.
Figure 10:
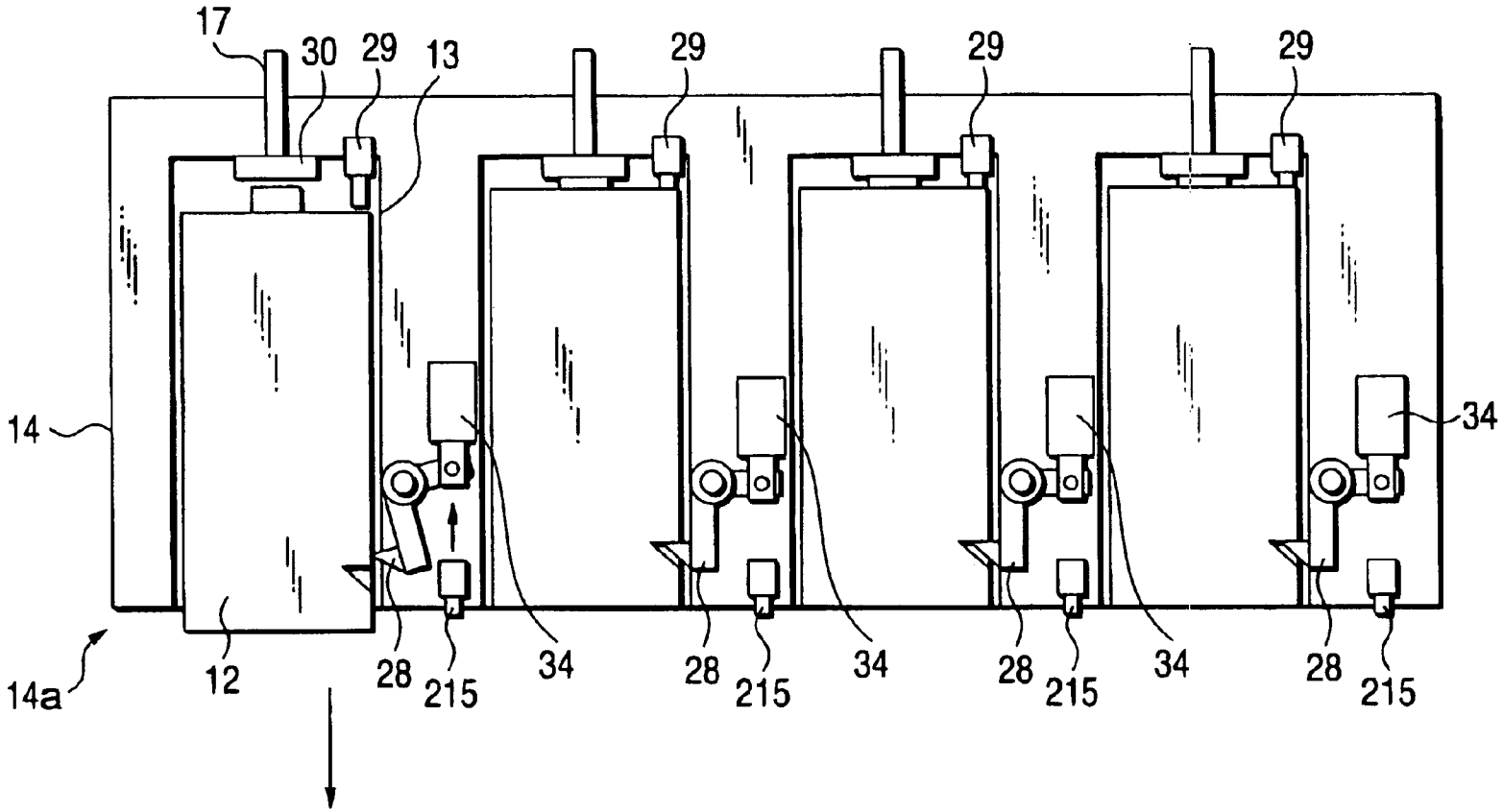
FIG. 10 is an explanatory diagram showing the ink-jet recording device according to the second embodiment of the present invention wherein the control mechanism enables removal of an ink cartridge.

FIG. 9 is an explanatory diagram, showing an ink-jet recording device according to a second embodiment of the invention, wherein a control mechanism disables removal of an ink cartridge. FIG. 10 is an explanatory diagram, showing the ink-jet recording device according to the second embodiment of the invention, wherein the control mechanism allows the removal of the ink cartridge.

It should be noted that for the second to fourth embodiments, the exterior and the internal configuration of the ink-jet recording device are substantially the same as those shown in FIGS. 1 to 3 for the first embodiment.

In this embodiment, a controller 27 is provided that disables removal of ink cartridges 12 during a removal inhibited period, and prevents air bubbles from entering ink flow paths due to the removal of the ink cartridges 12, which can be directly detachable, externally.

As shown in FIGS. 9 and 10, the ink-jet recording device includes: actuators (holding member driving units) 34 for rotating holding hooks 28 between an engagement position and a disengagement position for the ink cartridges 12; and eject buttons 215 for, when the actuators 34 rotate the holding hooks 28 to the disengagement position, projecting the ink cartridges 12 from ink cartridge loading units 13 so that they can be removed. Further, the controller 27 is further provided that, during a removal inhibited period, inhibits the use of the eject buttons 215 for driving the actuators 34, and that, during a period other than a removal inhibited period, allows the use of the eject buttons 215.

The operation of the thus arranged ink-jet recording device will now be described.

When an ink cartridge 12 is inserted into an ink cartridge loading unit 13, the ink cartridge 12 is connected to a cartridge connector 30, and the holding hook 28 urged clockwise by a spring (not shown) is fitted into a groove formed in the side face of the ink cartridge 12. Thus, the ink cartridge 12 connection can be maintained (FIG. 9).

Thereafter, during a removal inhibited period, such as a recording period or a head function recovery period, even when an eject button 215 is depressed, the controller 27 prevents the driving of an actuator 34, so that the ink cartridge 12 is not projected.

Further, during a period other than a removal inhibited period, as shown in FIG. 10, when the eject button 215 is depressed, the controller 27 which has detected a period other than a removal inhibited period, drives the actuator 34, then the holding hook 28 is rotated counterclockwise and is disengaged from the groove in the side face of the ink cartridge 12. The ink cartridge 12 can then be projected and removed. A spring (not shown) may be used to project the ink cartridge 12, or instead, a handle may be provided that a user can employ to remove the ink cartridge 12.

As described above, according to this embodiment, since the controller 27 disables removal of an ink cartridge 12 during a removal inhibited period, air bubbles can be prevented from entering an ink flow path due to the removal of the ink cartridge 12, which can be directly unmounted, externally.

(Embodiment 3)

Figure 11A:
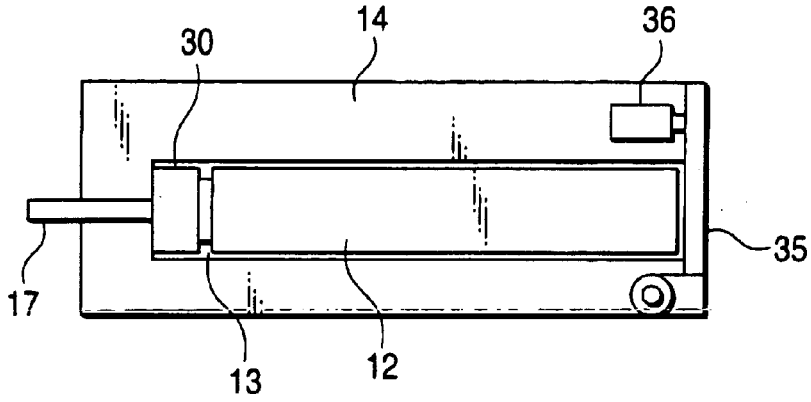
FIGS. 11A and 11B are explanatory diagrams showing an ink-jet recording device according to a third embodiment of the present invention wherein a control mechanism detects the start of an ink cartridge removal operation.
Figure 11B:
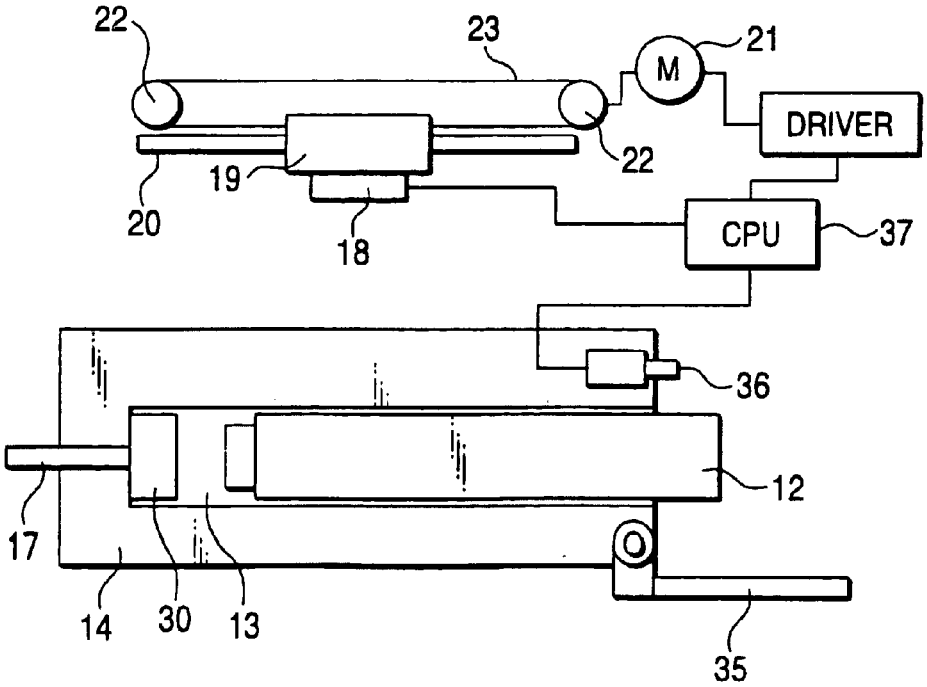

FIGS. 11A and 11B are explanatory diagrams, showing an ink-jet recording device according to a third embodiment of the present invention, wherein a control mechanism detects the start of an ink cartridge removal operation. FIG. 11A shows the state wherein the ink cartridge removal operation has not yet started. FIG. 11B shows the state wherein the ink cartridge removal operation has started. To simplify the illustration, a control system is shown only in FIG. 11B.

As shown in FIGS. 11A and 11B, a door 35, provided for the front face of an ink cartridge loading unit 13, can be opened or closed when an ink cartridge 12 has been inserted into the ink cartridge loading unit 13.

An operation detector 36 is also provided that detects the opening or closing of the door 35, and determines whether the removal of the ink cartridge 12 should be started when the door 35 is opened.

Further, a controller (removal controller) 37 is also provided. Thus, during a removal inhibited period, the operation detector 36 determines that removal of the ink cartridge 12 has started, i.e., detects the opening of the door 35, the controller 37 shifts the ink-jet recording device to the recording standby state, and allows the removal of the ink cartridge 12.

According to the ink-jet recording device of the embodiment, during a removal inhibited period, the door 35 is opened to exchange the ink cartridge 12 (FIG. 11B), this opening is detected by the operation detector 36. Then, the controller 37 immediately terminates a recording operation or a head function recovery operation and shifts the ink-jet recording device to the recording standby state.

Therefore, even when the ink cartridge 12 is removed during a removal inhibited period, the entry of air bubbles into an ink flow path is prevented, and the adverse affect of the removal of the ink cartridge 12 on the function of the recording head 18 can be minimized. Further, when the opening of the door is detected, instead of terminating a recording operation or a head function recovery operation, the holding hook 28 used in the first and second embodiment may be employed to engage the ink cartridge 12 and prevent its removal.

(Embodiment 4)

Figure 12:
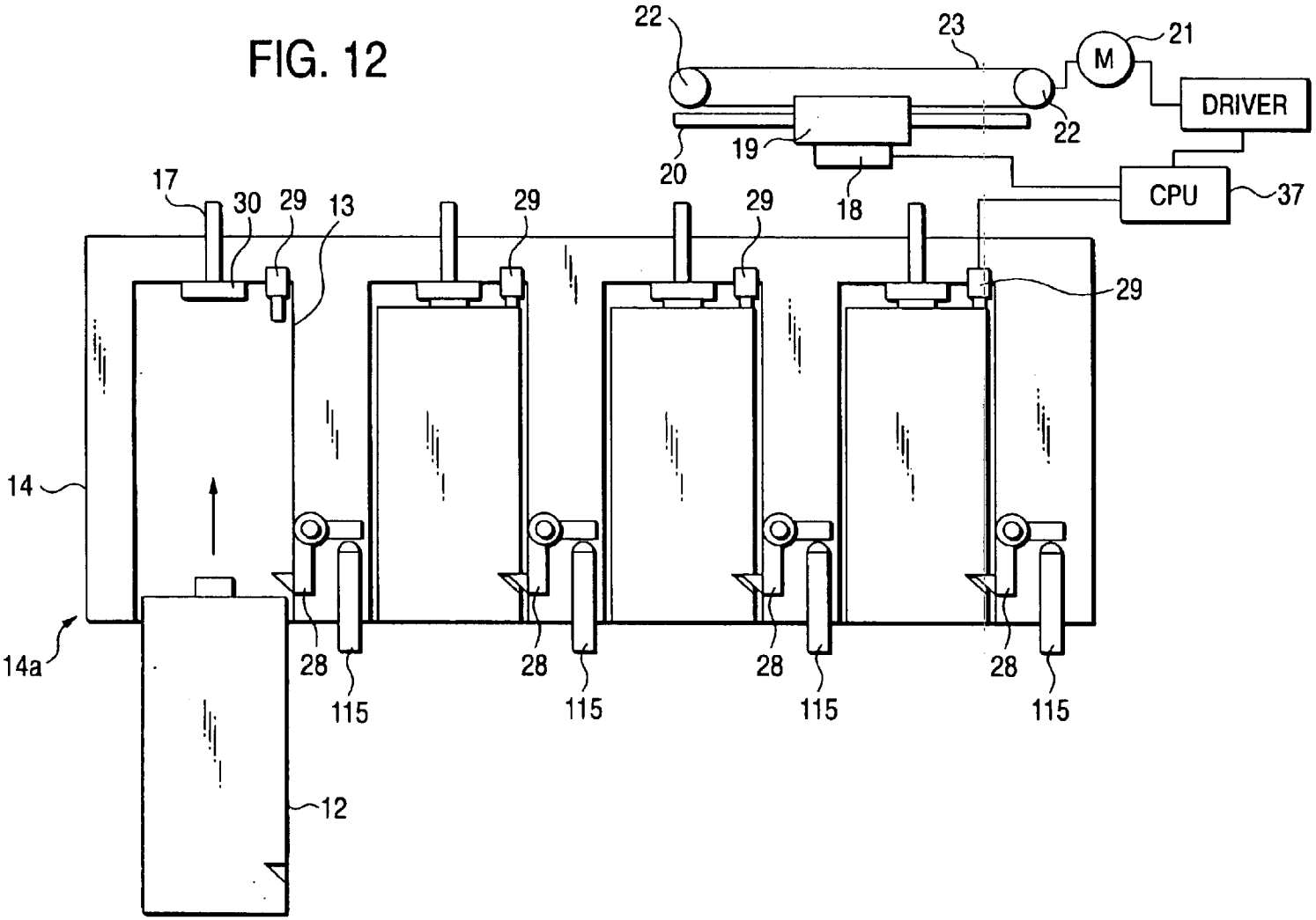
FIG. 12 is an explanatory diagram showing an ink-jet recording device according to a fourth embodiment of the present invention wherein a control mechanism has removed an ink cartridge.
Figure 13:
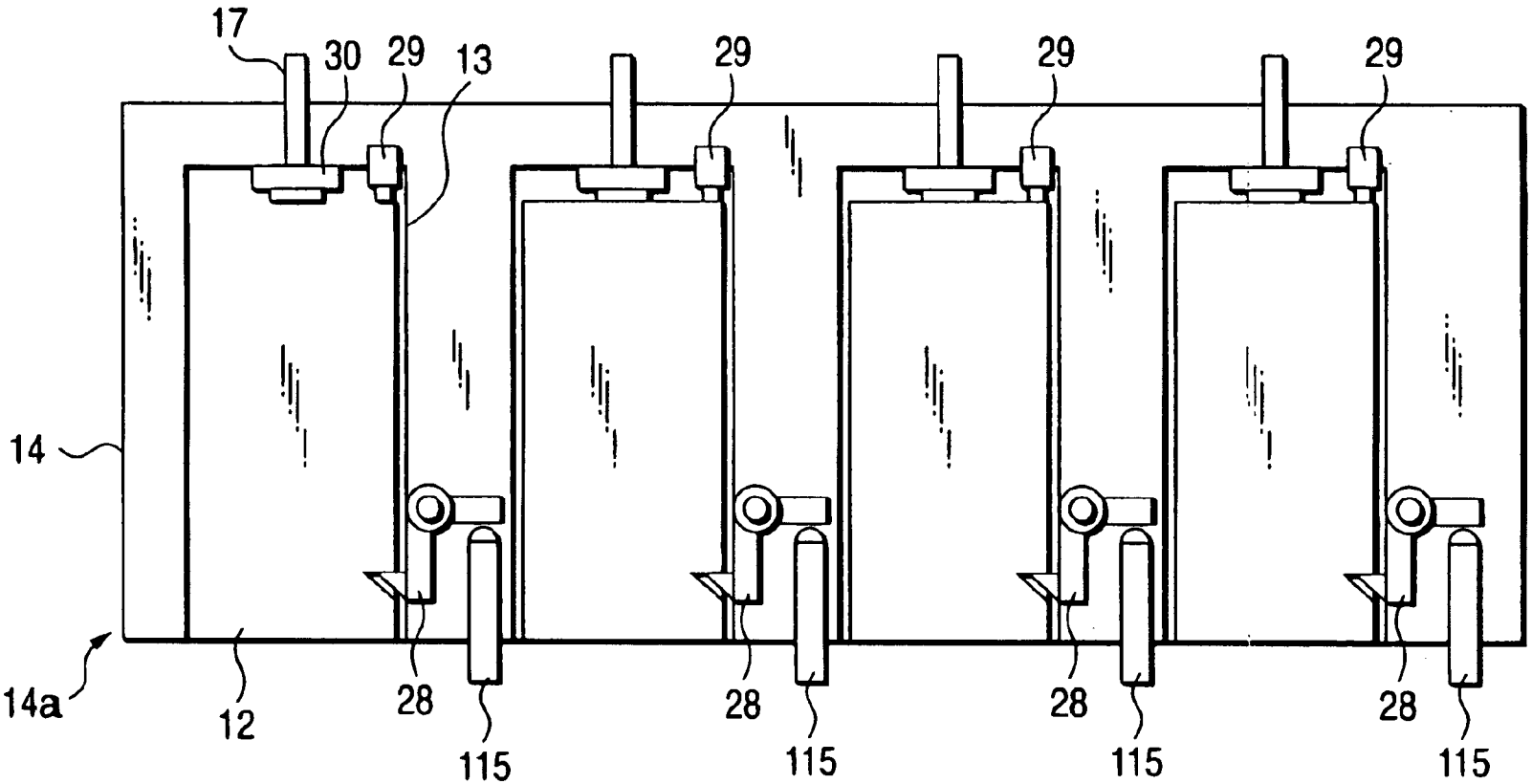
FIG. 13 is an explanatory diagram showing the ink-jet recording device according to the fourth embodiment of the invention wherein the control mechanism has loaded the ink cartridge.

FIG. 12 is an explanatory diagram, showing an ink-jet recording device according to a fourth embodiment of the present invention, wherein an ink cartridge is removed by a control mechanism. FIG. 13 is an explanatory diagram, showing an ink-jet recording device according to the fourth embodiment, wherein the ink cartridge is loaded by the control mechanism.

As shown in FIGS. 12 and 13, in the ink-jet recording device of the fourth embodiment, an ink cartridge loading unit 13 internally includes: a detection switch (removal detector) 29 for detecting the removal of an ink cartridge 12; and a controller 37 for shifting the ink-jet recording device to the recording standby state when the detection switch 29 detects the removal of the ink cartridge 12 during a removal inhibited period.

With this configuration, when the ink cartridge 12 is removed during a removal inhibited period, the detection switch 29 detects the removal, and thereafter, the controller 37 immediately terminates a recording operation or a head function recovery operation and shifts the ink-jet recording device to the recording standby state.

Therefore, even when an ink cartridge 12 is removed during a removal inhibited period, the entry of air bubbles into an ink flow path is prevented, and the adverse affect of the removal of the ink cartridge 12 on the function of the recording head 18 can be minimized.

According to the first to the fourth embodiments, the eject buttons 115, 215 are employed as switching units. However, any other switching unit can be employed so long as the ink cartridge 12 can be removed, and an eject button provided for a remote controller, or a command issued to a driver installed in a personal computer may be employed as a switching unit.

When ink cartridges 12 containing multiple colors are loaded, the controller 37 can individually disable or enable removal of each of them.

(Embodiment 5)

In the subsequent embodiments (Embodiments 5 to 12), the explanation regarding the removal inhibition unit as described in the foregoing embodiments is not omitted in the specification and the drawings, however, the removal inhibition unit may be applied to the subsequent embodiments.

An image quality as high as that provided by silver halide photography is demanded of an ink-jet printer, and for this, the maintaining and recovery of the function of a recording head is important. Maintaining or recovering the function of a recording head is performed by discharging the ink remaining in the recording head, and a waste ink reservoir, for storing discharged ink, must be internally provided for a device.

Figure 14:
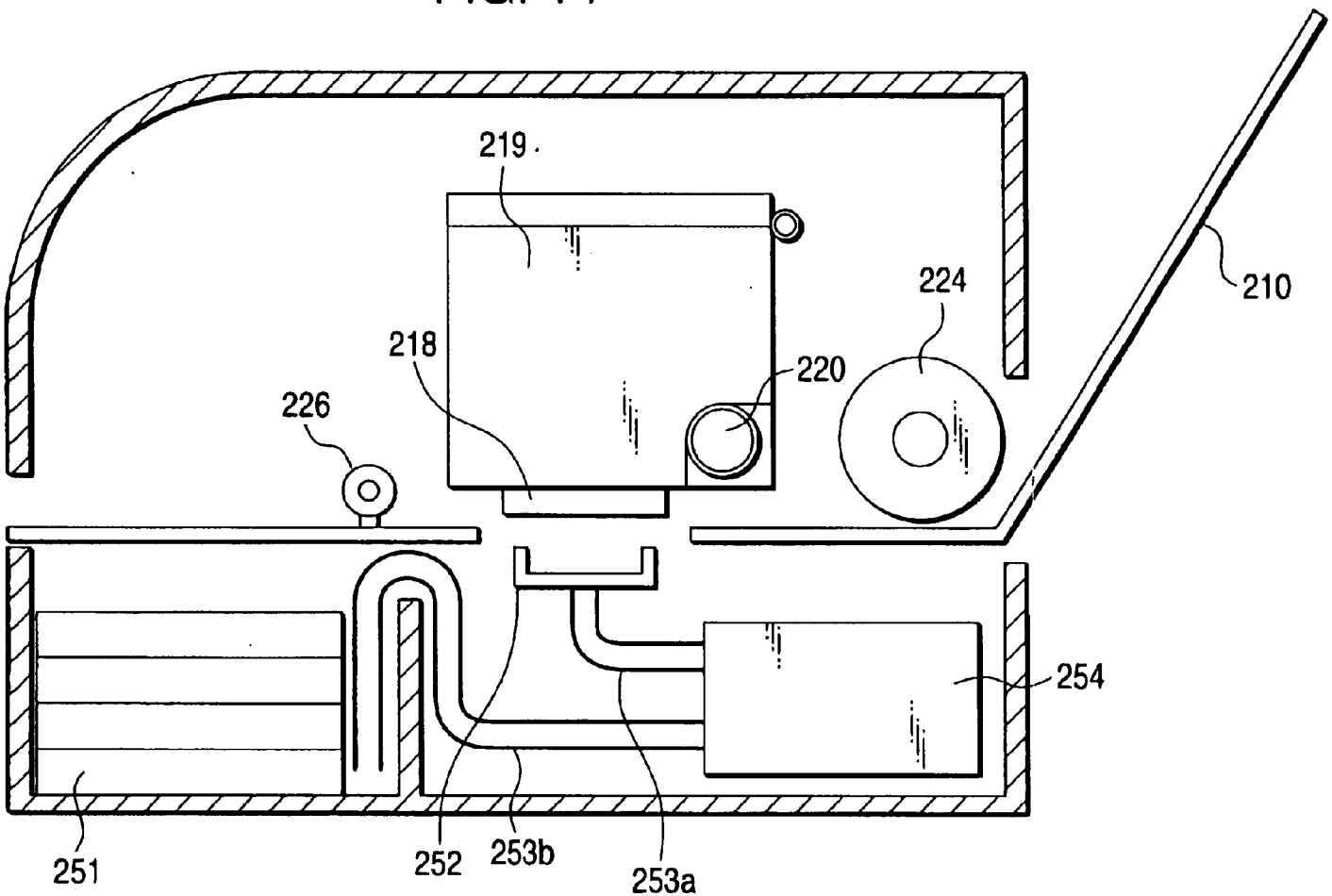
FIG. 14 is a schematic cross-sectional view of the internal structure of a general ink-jet recording device.

An ink-jet recording device with a waste ink reservoir will now be described. FIG. 14 is a schematic cross-sectional view of the internal structure of the ink-jet recording device.

As shown in FIG. 14, the ink-jet recording device includes: a carriage 219 which has a recording head 218 to which ink is supplied and which is supported by a carriage shaft 220 and is reciprocally moved in the main direction; a supply roller 224 for transporting individual recording sheets from a paper supply tray 210; a discharge roller 226 for discharging a recording sheet on which data has been recorded by the recording head 218; and a waste ink reservoir 251, wherein ink removed from the recording head 218 is stored.

At a recording standby position of the recording head 218, a cap 252 for covering the recording head 218 is so arranged it can be brought into contact with and separated from the recording head 218. One end of a waste ink transportation tube 253*a* is connected to the cap 252, and the other end of the waste ink transportation tube 253*a* is connected to a pump 254. When suction is applied to the interior of the recording head by the pump 254, bubbles and residual ink are sucked out of and removed from the ink flow path under negative pressure. Further, since the pump 254 communicates with the waste ink reservoir 251 via a waste ink transportation tube 253*b*, the waste ink removed by the pump 254 passes through the waste ink transportation tubes 253*a* and 253*b* and is stored in the waste ink reservoir 251.

When an ejection failure occurs in the ink-jet recording device due to the blocking of the ink flow path by air bubbles or by the clogging of nozzles, to recover the recording function, the recording head 215 is closed by the cap 252, suction is applied by the pump 254 and ink is sucked out through the nozzles of the recording head 218 under negative pressure.

The ink that is sucked out is waste ink, and passes through the waste ink transportation tubes 253*a* and 253*b* to the waste ink reservoir 251.

Next the fifth embodiment of the invention will be explained with reference to FIGS. 15 to 22.

Figure 15:
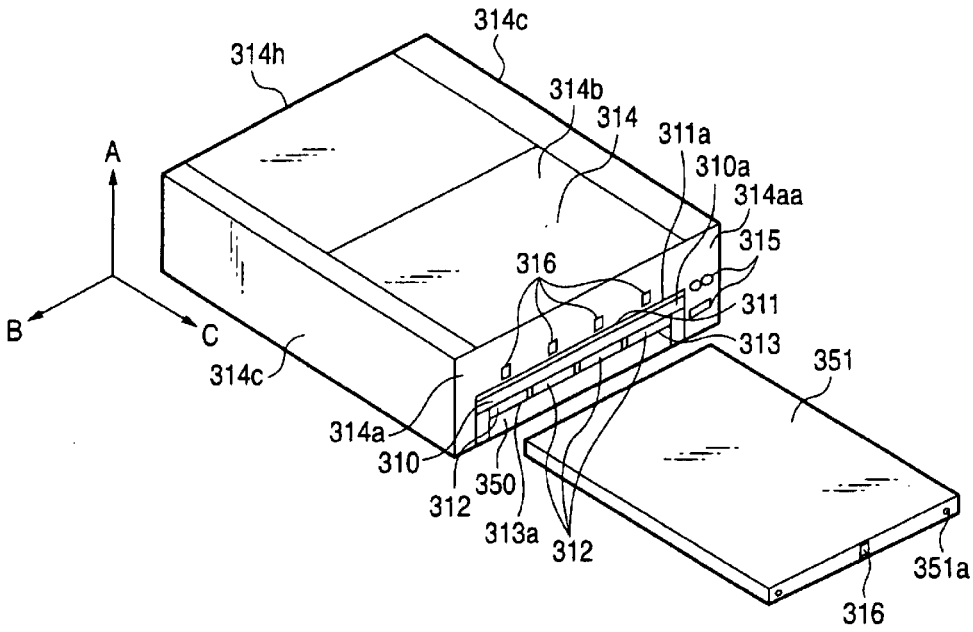
FIG. 15 is a perspective view of the exterior of an ink-jet recording device according to a fifth embodiment of the present invention.
Figure 16:
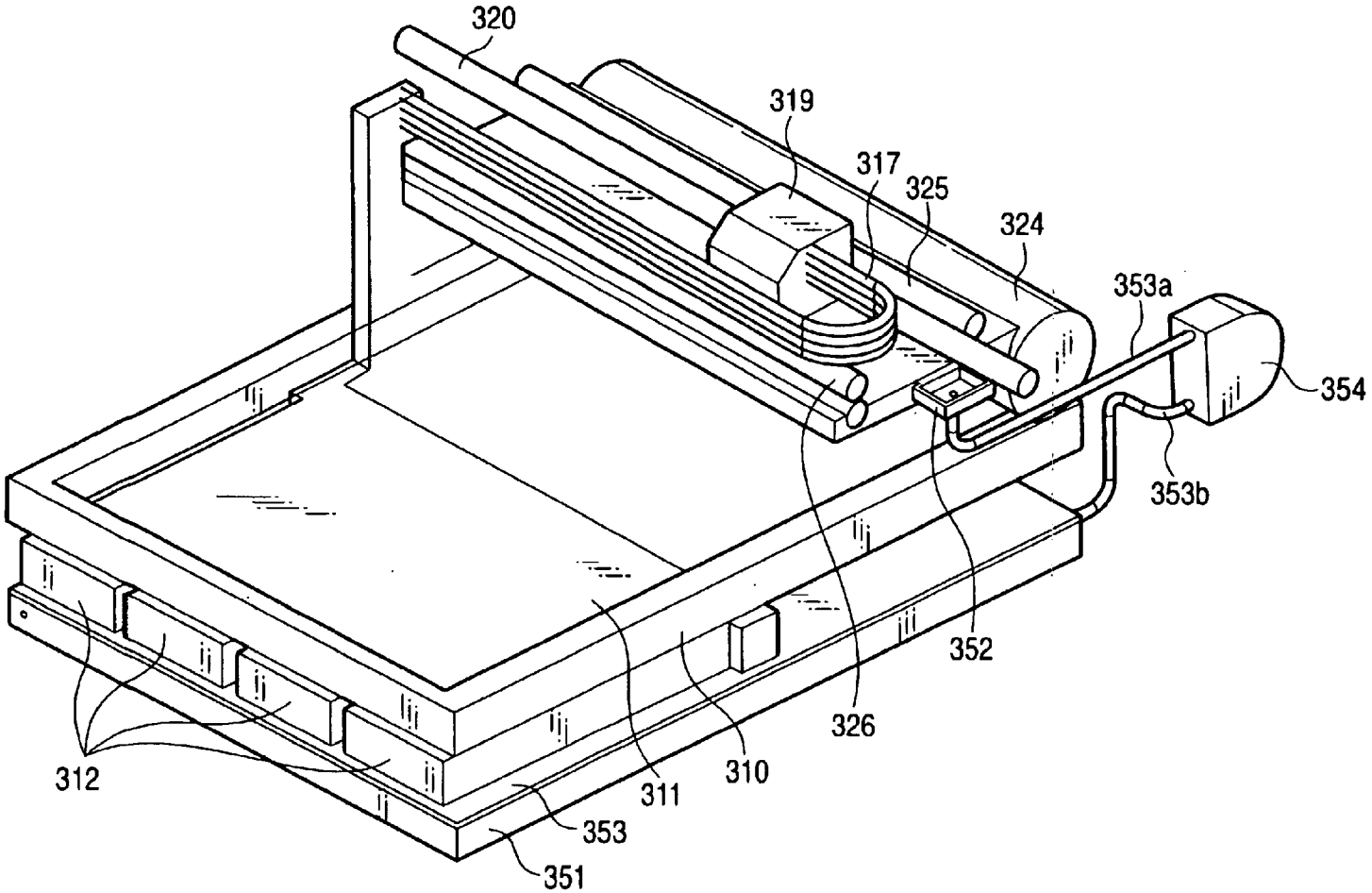
FIG. 16 is a perspective view of the internal structure of the ink-jet recording device in FIG. 15.
Figure 17:
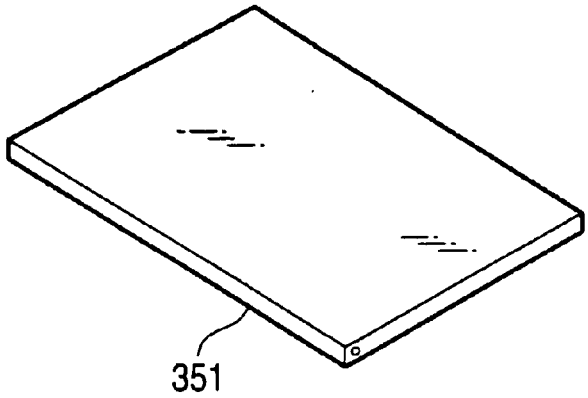
FIG. 17 is a perspective view of the waste ink reservoir in the ink-jet recording device in FIG. 15.
Figure 18:
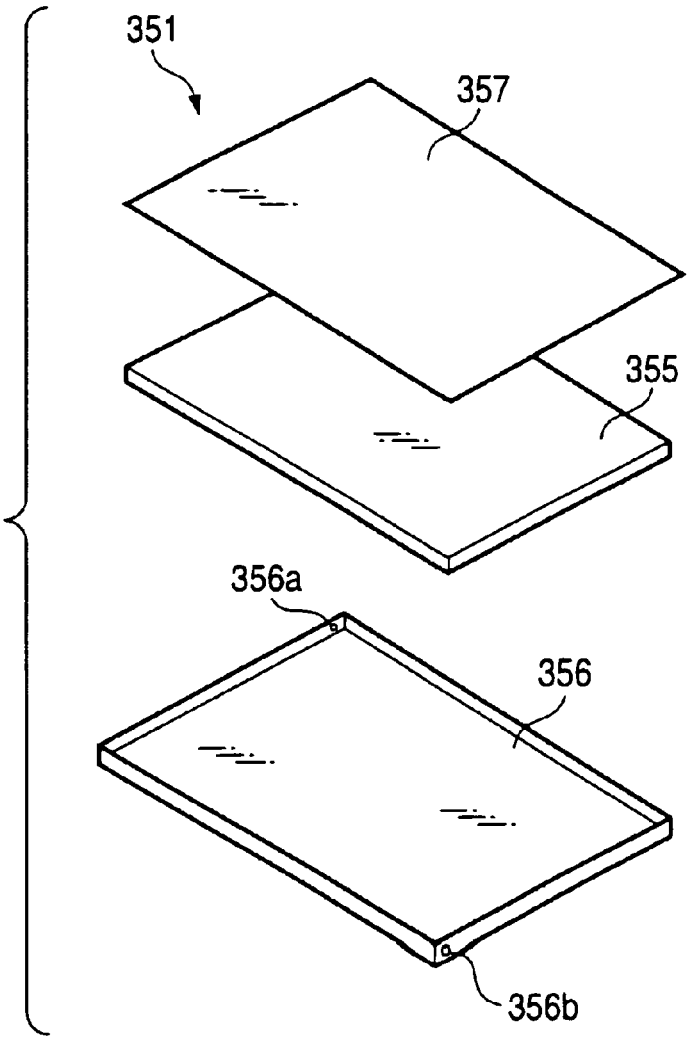
FIG. 18 is an exploded perspective view of the internal structure of the waste ink reservoir in FIG. 17.
Figure 19:
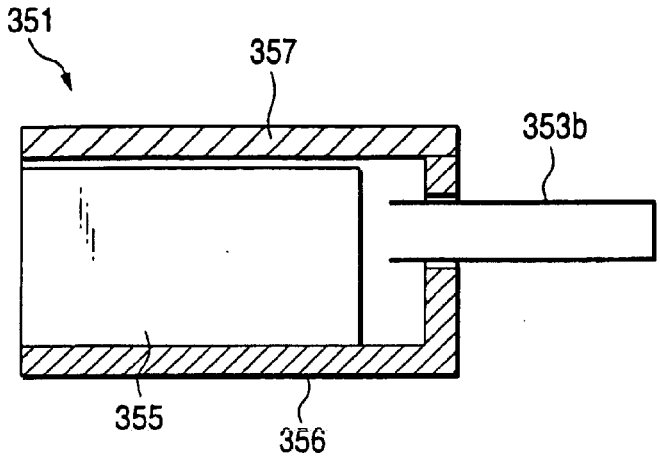
FIG. 19 is an enlarged cross-sectional view of part of the waste ink reservoir in FIG. 17.

FIG. 15 is a perspective view of the exterior of an ink-jet recording device according to a fifth embodiment of the invention. FIG. 16 is a perspective view of the internal structure of the ink-jet recording device in FIG. 15. FIG. 17 is a perspective view of a waste ink reservoir for the ink-jet recording device in FIG. 15. FIG. 18 is an exploded perspective view of the internal structure of the waste ink reservoir in FIG. 17. FIG. 19 is an enlarged cross-sectional view of one part of the waste ink reservoir in FIG. 17. As shown in FIG. 15, the ink-jet recording device in this embodiment includes: a paper discharge tray (medium discharge member) 311 to which recording sheets (recording media) are discharged after recording; a paper supply tray (medium supplying member) 310 from which recording sheets are supplied; ink cartridges (ink supply members) 312, which are replaceably loaded into ink cartridge loading units (ink supply member loading units) 313, and in which ink used for recording is contained; and a waste ink reservoir (waste ink retaining unit) 351, in which waste ink removed from a recording head is retained, all of which are located at a front face 314*a* of a main body 314 from above to below in the heightwise direction A of the device, and are extended inward in the main body 314.

Since the waste ink reservoir 351 and the ink cartridge loading units 313 are provided under the paper supply tray 310, new recording sheets can be prevented from being smeared by ink during the exchange of the ink cartridge 312 and the waste ink reservoir 351. Further, since the ink cartridge loading unit 313 and the waste ink reservoir 351 are also provided under the paper discharge tray 311, after recording, the recording sheets can also be prevented from being smeared by ink during the exchange of the ink cartridges 312 and the waste ink reservoir 351. In addition, since the paper supply tray 310 is located under the paper discharge tray 311, the recording face of the recording sheet that is inverted by a paper feed roller 324 is directed upward, so that the smearing of the recording face can be prevented and the recorded contents can be immediately confirmed. Moreover, with this configuration, the ink cartridges 312 can be exchanged without being passed over the paper supply tray 310 and the paper discharge tray 311. Therefore, an ink-jet recording device can be provided, for which the probability is less that recording sheets, before and after recording, will be smeared by ink and for which maintenance is easy.

An eject button (switching unit) 315, with which the waste ink reservoir 351 is projected from a waste ink reservoir loading unit 350 for removal, and an LED (notification unit) 316, which turns green when the waste ink reservoir 351 is loaded into the waste ink reservoir loading unit 350, and which turns red when the waste ink reservoir 351 is not loaded, are attached beside the waste ink reservoir 351. The LED 316 is located above, on the side or at the front of the ink cartridge 312 or the waste ink reservoir 351. The notification unit need not be the LED 316, and only the state wherein the ink cartridge 312 or the waste ink reservoir 351 is loaded or the state wherein the ink cartridge 312 or the waste ink reservoir 351 is not loaded need be reported. In addition, for controlling the ink-jet recording device, the notification unit may not be provided for the ink-jet recording device, but may instead be displayed on the monitor of an apparatus, such as a personal computer or a remote controller.

According to the ink-jet recording device, the waste ink reservoir 351 or the ink cartridge 312 can be removed by external access and replaced with new one.

Openings 313*a* (not shown) in the ink cartridge loading units 313, the face of the paper supply tray 310 near the front face 314*a*, the opening of the paper discharge tray 311 and the front face of the waste ink reservoir 351 are on the same plane, and a user can easily perform the required maintenance, such as the replenishment and the extraction of recording media, and the loading and unloading of the ink cartridges 312 and the waste ink reservoir 351.

When these faces are on the same plane, a user, within this range, can easily perform the required maintenance. More specifically, so long as the trays 310 and 311 and the reservoir 351 are located in the depthwise direction C within a range (±5 cm or less, though there are individual differences) wherein they can be manipulated by the user's fingers, the maintenance can be satisfactorily performed even when another apparatus, such as an audio deck or a video deck, is mounted on the main body 314.

In addition, since most of members, such as the operating switch 315, that are manipulated by a user are located near the front face 314*a* (or on the same plane) of the main body 314, a more usable ink-jet recording device can be implemented, wherein the available space is efficiently used. For the ink-jet recording device, a waste ink reservoir can be removed through the external access and can be replaced.

It is preferable that the direction (and/or the mounting face) in which the paper supply tray 310, the paper discharge tray 311, the ink cartridges 312, the ink cartridge loading units 313 and the waste ink reservoir 351 are mounted in the main body 314 be substantially parallel to the same face, because then, the thickness of the main body 314 can be reduced. It is especially preferable that the direction is substantially vertically (almost parallel to the plane defied by the heightwise direction A and the widthwise direction B), or the mounting face is substantially horizontally (almost parallel to the plane defined by the widthwise direction B and the depthwise direction C) because then, the thickness of the main body 314 can most effectively be reduced. In this case, the mounting direction (face) can be almost parallel to the same plane so long as the angle formed by the individual members is ±10° at the maximum, the mounting direction face can be substantially parallel so long as the angle formed by the members in the vertical direction is ±10° or less, and the mounting faces can be substantially parallel so long as the angle formed by the members in the horizontal direction is ±10° or less.

The ink cartridge loading units 313 include, for the individual ink cartridges 312, connectors (not shown) along which openings formed in the front face 314*a* of the main body 314, the space defined inside the main body 314, and the ink cartridges 312 communicate with the main body 314 by using fluid.

The spaces into which the ink cartridges 312 are loaded are arranged in the widthwise direction B, and the shape of the ink cartridge 312 to be loaded is an almost rectangular parallelepiped that is elongated in the order in the heightwise direction A, the widthwise direction B and the depthwise direction C. With this structure, the length of the main body 314 in the heightwise direction A is shorter, and the height of the overall device is lowered. Therefore, the strength of a side wall 314*c* of the main body 314, which presents a problem when an object is mounted on an upper face 314*b* of the main body 314, can be increased, as can the permissible load that can be imposed on the main body 314, and accordingly, the effective use of the available space can be improved. Further, since the size of the ink cartridge 312 in the vertical direction can also be reduced, back pressure fluctuation, which occurs due to the shifting of the surface level of the ink as it is reduced, can be minimized, and a stable ink supply can be implemented.

In this embodiment, the ink cartridge loading units 313 define spaces for the individual ink cartridges 312; however, multiple (e.g., two or four) ink cartridges may be loaded in one space. Further, in this embodiment, all (four) of the ink cartridges 312 are arranged in the widthwise direction B; however, the ink cartridges 312 may be shaped taller in the heightwise direction A and narrower in the widthwise direction B, and multiple units maybe stacked in the heightwise direction A (e.g., every two or all four).

The user can remove the ink cartridge 312 through external, direct access of the main body 314, and load a new ink cartridge 312. The exchange of the ink cartridge 312 can be performed in this manner.

Furthermore, as described in this embodiment, the ink cartridges 312 and the waste ink reservoir 351 can be detached from the same front face 314*a* in the same direction. Therefore, while conventionally the ink cartridges can not be exchanged unless the cover provided for the main body is opened wide above the height of the main body and the waste ink reservoir (waste ink absorption member) can not be exchanged at all, in this embodiment the ink cartridges 312 and the waste ink reservoir 351 can be easily exchanged through external, direct access. Therefore, the performing maintenance for the ink-jet recording device can be greatly simplified, the size of the ink absorption member, which conventionally is large, can be reduced, as can the size of the ink-jet recording device. Further, since the ink cartridges 312 and the waste ink reservoir 351 can be inserted or removed in the same direction, maintenance for the ink-jet recording device can be simplified. Therefore, a small and usable ink-jet recording device can be provided.

In this embodiment, the ink cartridges 312, containing black, cyan, magenta and yellow inks, are loaded. In addition, ink cartridges filled with so-called photoink, such as light cyan, light magenta and dark yellow, maybe provided to increase the image quality. In this case, six or seven spaces are defined for the ink cartridges 312, depending on the number of ink colors used. In addition, in accordance with the amount of ink to be used, a black ink cartridge may be larger than the others, or color ink cartridges may be integrally formed as a single unit.

The operating switch (operating member) 315, arranged on a side portion 314*aa* of the front face 314*a*, is manipulated to operate the ink-jet recording device. The operating switch 315 may not be arranged on the same plane as the front face 314*a*, but on another plane provided in the same direction as the front face 314*a*.

Since the operating switch 315 is arranged on the front face 314*a* of the main body 314, a user-friendly device can be provided, that permits a user to manipulate the operating switch more easily than when it is arranged on the upper face 314*b* or a side face 314*c*, and objects can be placed on the upper face 314*b* or adjacent to the side faces 314*c*. That is, this configuration is preferable because the peripheral space, around the main body 314 can be used more efficiently.

The normal line of the front face 314*a* is perpendicular to the plane defined by the directions A and B, and the front face 314*a*, the upper face 314*b* and the side faces 314*c* are also shown as being perpendicular. However, the angle formed by the front face 314*a* need not always be a right angle, and may be smaller (it may be sharply inclined away from the user), and the individual portions of the front face 314*a* need not always be flat, but may be complicatedly curved. When the front face 314*a* is inclined relative to the perpendicular direction of the normal line, the size of the front face 314*a* can be increased, and the size and the number of the operating switches 315 provided on the front face 314*a* can be increased. Therefore, the usability of the device can be improved. In this embodiment, only the operating switch 315 is shown as an operating member; however, a display unit, such as a liquid crystal display device or an LED, or a touch panel, may be provided, or a slot for inserting a semiconductor memory. A connector for connecting a PC or an STB may also be provided on the front face 314*a*. It is especially preferable, for appearances sake, that a connector that is constantly employed be provided on a rear face 314*h*, because then a connection cable can be hidden from a user.

In substantially the same direction, the recording media are removed from (or fed to) the paper supply tray 310; the recording media, after recording, are removed from (or discharged to) the paper discharge tray 311; the ink cartridges 312 are unloaded from (or loaded into) the ink cartridge loading units 313; and the waste ink reservoir 351 is unloaded from (or loaded into) the main body 314. Substantially the same direction means that the main components of the vectors representing the input or output direction are the same, and in this case, it also means that the main component is the depthwise direction C, even when there are some vector components present in the heightwise direction A and the widthwise direction B.

With this configuration, the user can perform all accesses for maintenance of the device in one direction, and an ink-jet recording device having superior usability can be implemented. Especially, unlike the conventional case, a cover extended over multiple faces (e.g., the front face 314*a* and the upper face 314*b*) of the device need not be opened to exchange the ink cartridges 312 and the waste reservoir 351, so that the maintenance is very superior and so that less arrangement of objects around the periphery of the device (especially on the upper face) is required when the ink cartridges 312 and the waste ink reservoir 351 are replaced.

In this embodiment, the trays are employed where the recording media are stacked. However, cassettes detachable from the main body may be employed. When a slot for inserting a semiconductor memory is provided, it is preferable that the semiconductor memory is loaded in the same direction as described above.

Further, in this embodiment, the paper supply tray 310, the paper discharge tray 311, the ink cartridges 312 and the waste ink reservoir 351 are so arranged that they can be accessed from the front face 314*a* of the main body 314. However, these components need only be arranged so they can be accessed from a specific face, and some beneficial effects can be realized even when not all the components are arranged on the front face 314*a*.

In addition, the paper supply tray 310, the paper discharge gray 311, the ink cartridges 312 and the waste ink reservoir 351 may also be arranged on different faces.

It is preferable that the upper face 314*b* of the main body 314 is as flat as possible because documents or files can be easily displayed on the upper face 314*b*. Further, it is preferable that, generally, the portions (usually the four corners of the main body 314) of the device that correspond to the legs of the products is formed at the same height, because electric products, such as an audio deck and a video deck, that tend to be part of the equipment found in a living room, can then be stacked stably. In this case, so long as the portions at the four corners are substantially at the same height, the other portions need not be at the same height, and either the shape shown in FIG. 15, or a structure having projections only at the four corners may be employed. In addition, it is preferable that the portions whereon another apparatus will be stacked is reinforced more than the other portions so that multiple apparatuses can be held thereon. At this time, it is preferable that a user is able to identify the reinforced positions because the main body 314 will not be broken by the incorrect stacking of apparatuses. In this case, the reinforced positions may be identified by marking them, or by describing them in manuals.

As shown in FIG. 16, a recording head 318, to which ink is supplied from the ink cartridges 312 through tubes 317, is provided for a carriage 319, and the carriage 319 is supported by a carriage shaft 320 and is reciprocally moved by a carriage motor 321 in the main scanning direction, the carriage 319 is fixed to a belt that is put around a pair of pulleys, and as a rotation force provided by the carriage motor is transmitted to one of the pulleys, the belt is rotated and the carriage reciprocates.

A pickup roller (not shown) for individually recording sheets from the paper supply tray 310 to a lower path that is a part of a paper transporting path, the supply roller 324 for inverting the recording sheet along the lower path and guiding the inverted sheet to an upper path which is another part of the sheet transporting path, a feed roller 325 for transporting the recording sheet along the paper transporting path, and discharge rollers 326 for discharging the recording sheet to the paper discharge tray 11 after recording, are arranged in the named order in the direction in which the recording sheet is fed.

The tubes 317 are so arranged, together with a cable along which a head drive signal is transmitted from a drive signal generator to the recording head 318, that they do not interfere with the transporting of the recording sheet and the movement of the carriage 319.

A cap 352, for covering the recording head 318, is located at the recording standby position for the recording head and can be brought in contact with or separated from the recording head 318. One end of waste an ink transportation tube 353*a* is connected to the cap 352 and the other end is connected to a pump 354, and when suction is applied to the interior of the recording head 318 by the pump 354, air bubbles or residual ink are removed from the ink supply path under negative pressure.

The pump 354 communicates with the waste ink reservoir 351 via a waste ink transportation tube 353*b*, and waste ink removed by the pump 354 passes through the waste ink transportation tubes 353*a* and 353*b* and is retained in the waste ink reservoir 351.

According to the thus arranged ink-jet recording device, a recording sheet is individually fed from the paper supply tray 310, loaded from the front face 314*a*, to the lower path and is inverted by the supply roller 324 arranged at the rear of the device, and is guided to the upper path. While the recording sheet passes along the upper path, the printing of the recording sheet is performed on a platen, and the sheet after recorded is discharged to the paper discharge tray 311.

Then, the recording sheet can be removed by directly accessing the paper discharge tray 311 from the front face 314*a*.

In this ink-jet recording device, when an ejection failure occurs due to air bubbles retained along the ink supply path or the clogging of nozzles, the recording head 318 is covered by the cap 352 in order to recover the recording function, and under negative pressure, ink is sucked through the nozzles of the recording head 318 by the pump 354.

The ink is then transmitted as waste ink through the waste ink transportation tubes 353*a* and 353*b* to the waste ink reservoir 351. When the waste ink reservoir 351 is filled, the waste ink reservoir 351 is removed from a waste ink reservoir loading unit 352 and a new one is loaded.

As shown in FIGS. 17 to 19, the waste ink reservoir 351 includes a waste ink absorption member 355, such as a felt or macromolecular absorption member; a case 356, wherein the waste ink absorption member 355 is accommodated and wherein a waste ink introduction port 356*a* and an air release port 356*b* are formed; and a cover 357 for covering the case 356 and enclosing the waste ink absorption member 355.

As described above, according to this embodiment, since the waste ink reservoir 351 is replaceably loaded inward of the front face 314*a* of the main body 314, both the capacity and the size of the waste ink reservoir 351 can be reduced.

Further, since the waste ink reservoir 351 can be removed from the front face 314*a* of the main body 314, the waste ink reservoir 351 can be easily changed without moving an ink-jet recording device on which other apparatuses are stacked.

Furthermore, since the waste ink reservoir 351 can be removed from the front face 314*a* of the main body 314, the efficiency of the exchange operation can be improved and the processing period can be reduced.

Figure 20:
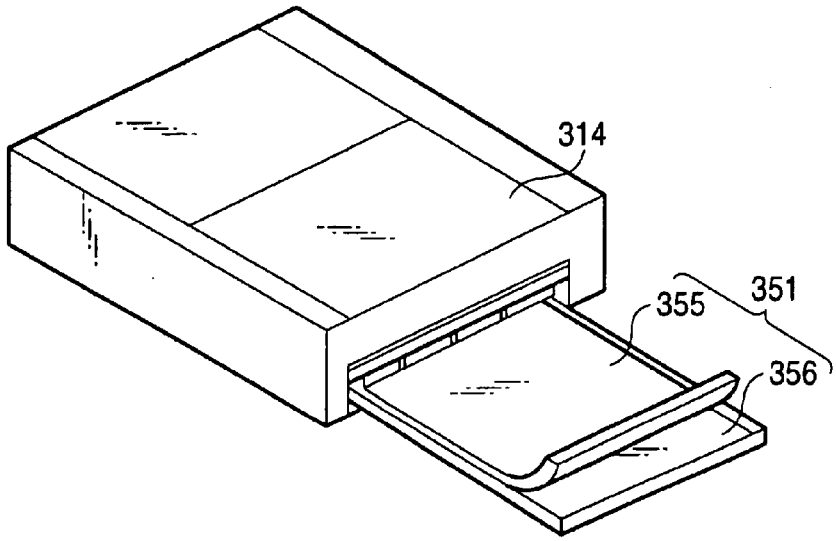
FIG. 20 is a perspective view of the exterior of a first modification of the ink-jet recording device for the fifth embodiment of the present invention.

As shown in FIG. 20, the waste ink reservoir 351 may be constituted by a waste ink absorption member 355 and a case 356 in which the waste ink absorption member 355 is placed, except for the cover 357 (FIG. 18), and may be exchanged by pulling out the case 356. In this case, the waste ink absorption member 355 for absorbing the waste ink serves as the waste ink reservoir.

When the waste ink absorption member 355 is directly exchanged, the hands or clothes of the user may be smeared by ink. Therefore, it is preferable that the waste ink absorption member 355 be placed in the case 356 while still enclosed within a wrapping material, such as a sheet material, that prevents the permeation of ink.

Figure 21:
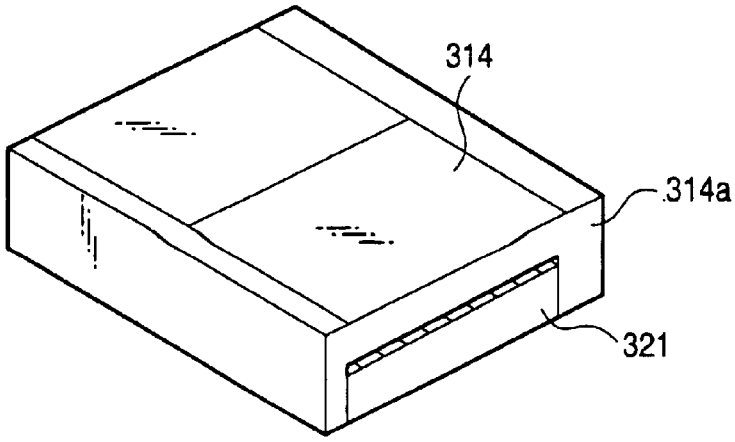
FIG. 21 is a perspective view of the exterior of a second modification of the ink-jet recording device for the fifth embodiment of the present invention.
Figure 22:
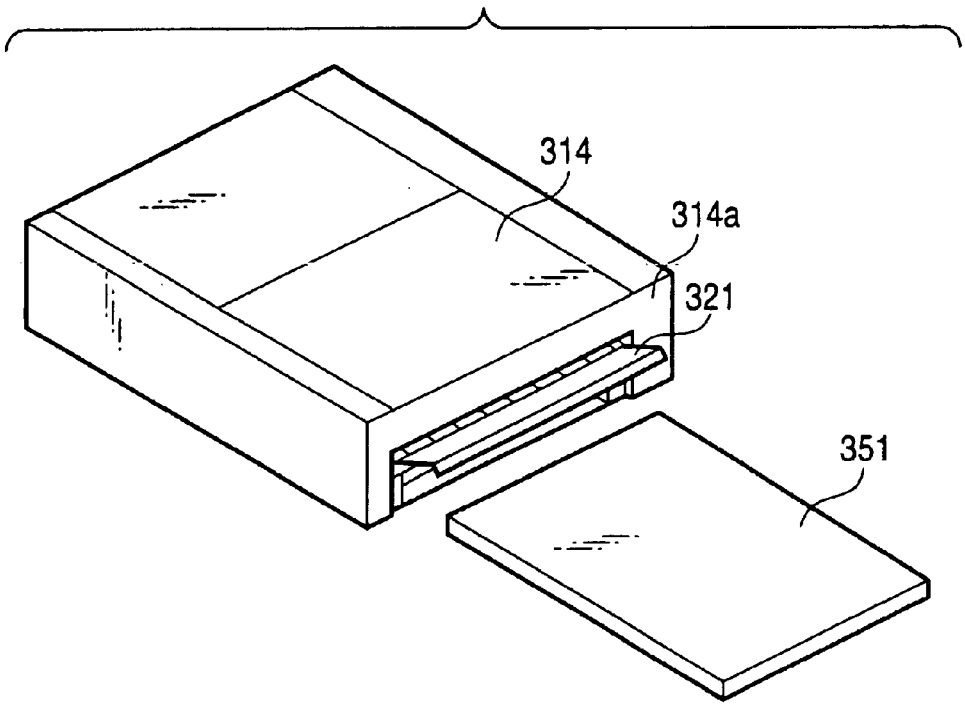
FIG. 22 is a perspective view of the ink-jet recording device in FIG. 21 wherein a waste ink container is removed by opening a cover.

Furthermore, as shown in FIGS. 21 and 22, an open/closed cover 321 for covering the waste ink reservoir 351 and the ink cartridges 312 that have been inserted, may be attached to the front face 314*a* of the main body 314 wherein the waste ink reservoir 351 is loaded. The cover 321 is so formed that it does not exceed the height of the main body 314, regardless of whether it is open or closed (or partially open). With this configuration, the cover 321 can be comparatively freely opened or closed, regardless of state of peripheral objects (how objects, such as documents, books and AV devices, are arranged) Thus, an ink-jet recording device having superior usability is implemented. While especially taking into account the stacking of the apparatus with a general AV device supported by legs, the size of the cover 321, open or closed, may exceed the height of the main body 314 by the length of the legs.

In this case, the cover 321 is provided in common for the ink cartridges 312 and the waste ink reservoir 351. However, a cover 321 may be provided separately.

In addition to the cover 321, a control member having a different structure than the cover can be employed, so long as it limits access to the ink cartridge 312 or the waste container 351. The control member need not completely hide the ink cartridge 312 or the waste ink reservoir.

(Embodiment 6)

Figure 23:
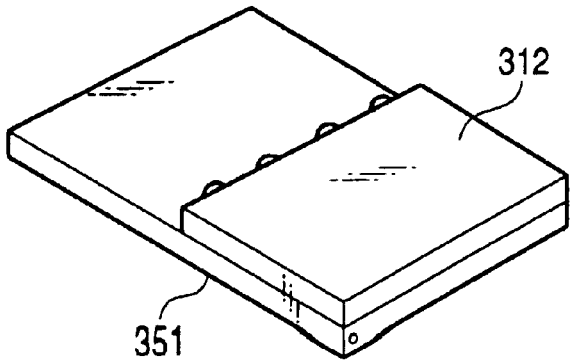
FIG. 23 is a perspective view of the structure of the waste ink reservoir of an ink-jet recording device according to a sixth embodiment of the present invention.
Figure 24:
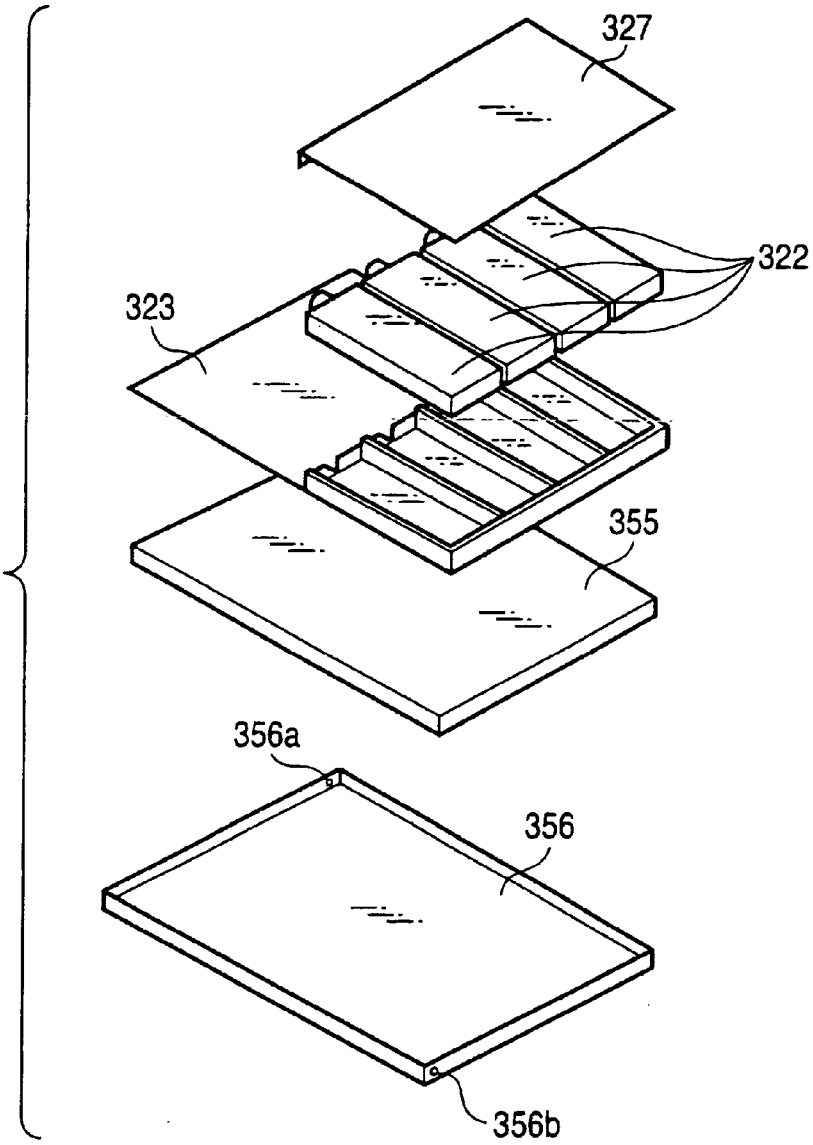
FIG. 24 is an exploded perspective view of the waste ink reservoir in FIG. 23.

FIG. 23 is a perspective view of the structure of a waste ink reservoir in an ink-jet recording device according to a sixth embodiment of the invention. FIG. 24 is an exploded perspective view of the structure in FIG. 23. It should be noted that in the embodiments 6 to 9, the schematic configuration of the ink-jet recording device is the same as that for the fifth embodiment.

In this embodiment, as shown in FIG. 23, a waste ink reservoir 351 is integrally formed with an ink cartridge (ink supply member) 312 in which ink used for recording is contained, and the assembly of the waste ink reservoir 351 and the ink cartridge 312 is replaceably loaded into a front face 314*a* of a main body 314.

As shown in detail in FIG. 24, the waste ink reservoir 351 includes: a waste ink absorption member 355; a case 356, into which the waste ink absorption member 355 is placed, having a waste ink introduction port 356*a* and an air release port 356*b*; a cover 323 for covering the case 356 and enclosing the waste ink absorption member 355 and for holding ink containers 322; and a cover 327 for covering the ink container 322.

An ink container 322 is non-refillable and is disposed of when the ink is exhausted. And the capacity of the waste ink container 351 is adequate for storing the waste ink that has been generated by the time an ink container 322 is emptied. The ink container 322 may be replaced.

According to this embodiment, when the waste ink reservoir 351 and the ink cartridges 312 are integrally formed, the waste ink reservoir 351 can be exchanged at the same time as the ink cartridges 312 are replaced. Therefore, the volume of the waste ink container 351 and the size of the ink-jet recording device can be reduced.

Further, since the waste ink container 351 and the ink cartridges 312 are integrally formed, both of them can be exchanged at the same time, the operation is simplified.

In addition, since the waste ink reservoir 351 and the ink cartridges 312 can be exchanged at the front face 314*a* of the main body 314, the efficiency of the exchange operation is improved and the length of the processing period is reduced.

(Embodiment 7)

Figure 25:
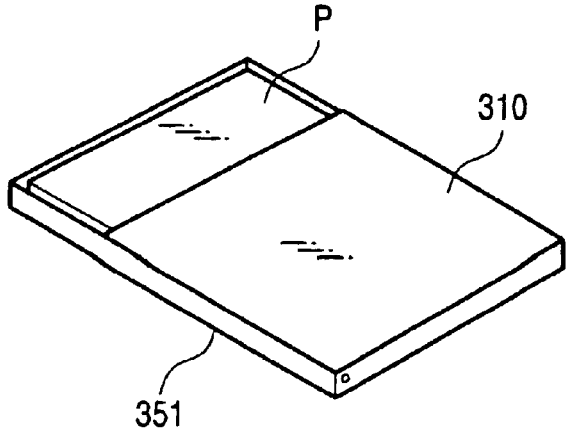
FIG. 25 is a perspective view of the structure of the waste ink reservoir of an ink-jet recording device according to a seventh embodiment of the present invention.
Figure 26:
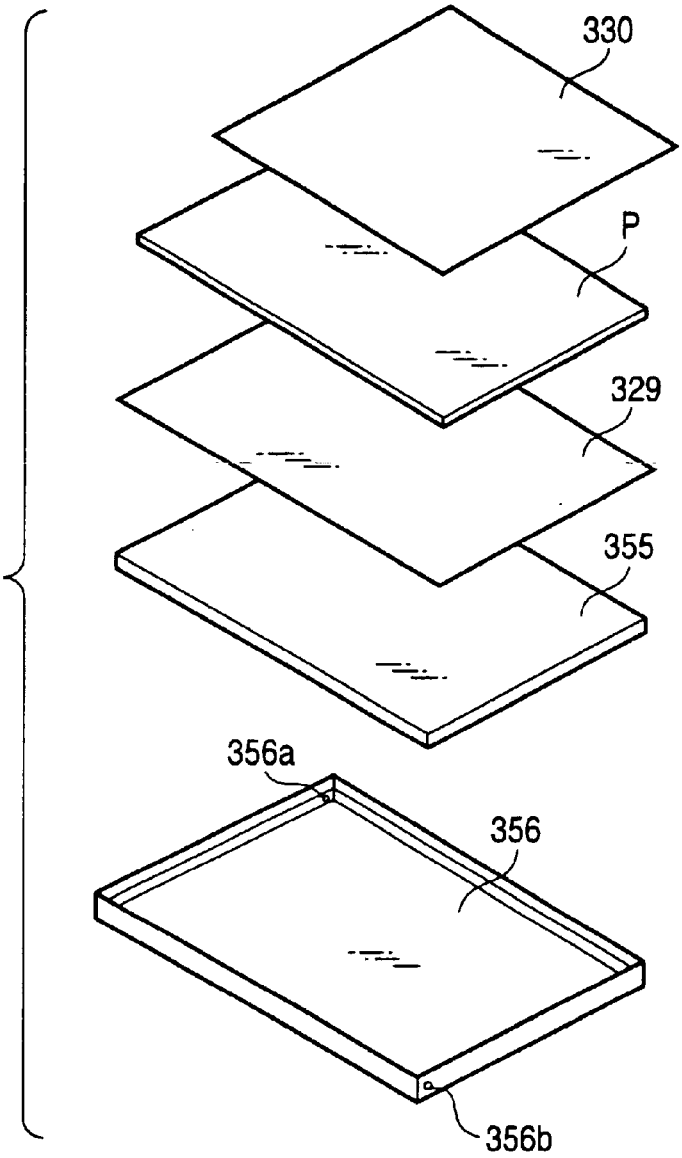
FIG. 26 is an exploded perspective view of the waste ink reservoir in FIG. 25.

FIG. 25 is a perspective view of the structure of a waste ink reservoir in an ink-jet recording device according to a seventh embodiment of the present invention. FIG. 26 is an exploded perspective view of the structure in FIG. 25.

In this embodiment, as shown in FIG. 25, a waste ink reservoir 351 is integrally formed with a paper supply tray (medium supplying member) 310, in which data recording sheets P are stored, and the assembled waste ink reservoir 351 and paper supply tray 310 are replaceably loaded to the front face of a main body.

Specifically, as shown in detail in FIG. 26, the waste ink reservoir 351 includes: a waste ink absorption member 355; a case 356 in which the waste ink absorption member 355 is placed, and which has a waste ink introduction port 356*a* and an air release port 356*b*; a cover 329 which provides a surface on which recording sheets P are accumulated and which covers the case 356 enclosing the waste ink absorption member 355; and a cover 330 which covers the top recording sheet P except for the portion thereof that is picked up when the sheet is fed.

The replenishment of the recording sheets P on the paper supply tray is disabled and the paper supply tray 310 is disposed of when the supply of recording sheets P is exhausted. And the capacity of the waste ink reservoir 351 is adequate for storing the waste ink that has been generated by the time the supply of recording sheets P is exhausted. It should be noted that the recording sheets P on the paper supply tray 310 may be replenished, and that it is preferable that, even when the replenishment of the recording sheets P has been disabled by a user, the resupply of the recording sheets P be performed by a maker, because recycling the tray is efficient. As a result, an ecologically friendly ink-jet recording device can be provided.

As described in this embodiment, when the waste ink reservoir 351 is integrally formed with the paper supply tray 310, both of them can be exchanged at the same time. As a result, the volume of the waste ink container 351 and the size of the device can be reduced.

Furthermore, since the waste ink reservoir 351 and the paper supply tray 310 can be exchanged at the front face 314*a* of the main body 314, the efficiency of the exchange operation can be improved and the processing period can be reduced.

(Embodiment 8)

Figure 27:
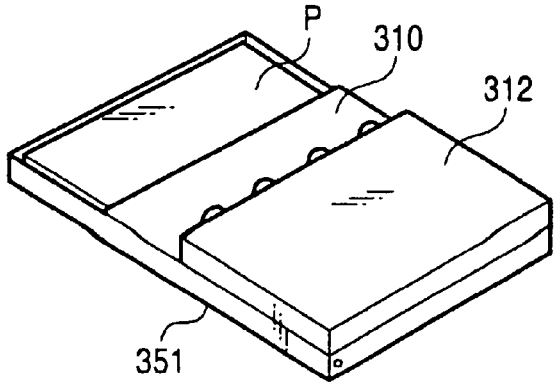
FIG. 27 is a perspective view of the structure of the waste ink container of an ink-jet recording device according to a eighth embodiment of the present invention.
Figure 28:
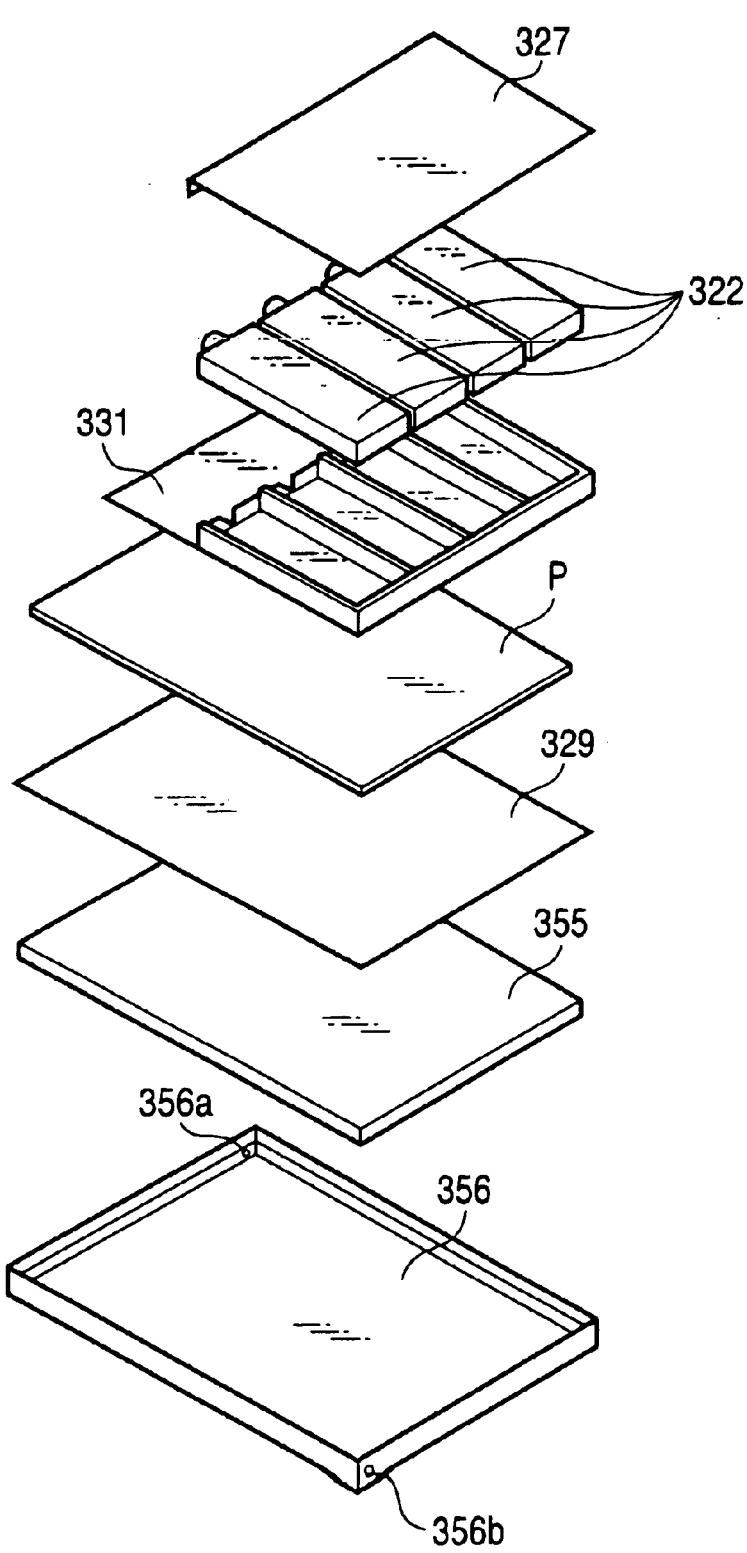
FIG. 28 is an exploded perspective view of the waste ink container in FIG. 27.

FIG. 27 is a perspective view of the structure of a waste ink reservoir in an ink-jet recording device according to an eighth embodiment of the present invention. FIG. 28 is an exploded perspective view of the structure in FIG. 27.

According to this embodiment, as shown in FIG. 27, a waste ink reservoir 351 is integrally formed with a paper supply tray (medium supply member) 310 and ink cartridges (ink supply members) 312, and this assembly is replaceably loaded at a front face 314*a* of a main body 314.

Specifically, as shown in detail in FIG. 28, the waste ink reservoir 351 includes a waste ink absorption member 355; a case 356 in which the waste ink absorption member 355 is placed and which has a waste ink introduction port 356*a* and an air releasing port 356*b*; a cover 329 which provides a surface on which recording sheets P are accumulated and which covers the case 356 enclosing the waste ink absorption member 355; a cover 331, which covers the top recording sheet P except for the portion thereof that is picked up when the sheet is fed and which holds ink containers 322; and a cover 327 which covers the ink container 322.

Further, the refilling of the ink containers 322 and the replenishment of the recording sheets P on the paper supply tray 310 are disabled, and the container 322 and the tray 310 are disposed of when the supply of ink and recording sheets P is exhausted. The capacity of the waste ink reservoir 351 is adequate for storing the waste ink produced by the time the ink in the ink containers 322 or the supply of recording sheets P on the paper tray 310 is exhausted. It should be noted, however, that the ink container 322 may be refilled and the paper tray 310 may be resupplied with recording sheets P.

As described in this embodiment, when the waste ink container 351 is integrally formed with the paper supply tray 310 and the ink cartridges 312, all of them can be exchanged at the same time. Therefore, the volume of the waste ink reservoir 351 and the size of the device can be reduced.

In addition, since the waste ink reservoir 351 is integrally formed with the paper supply tray 310 and the ink cartridges 312 and all of them can be exchanged at the same time, the operation is simplified.

Furthermore, since the exchange of the waste ink reservoir 351, the paper supply tray 310 and the ink cartridges 312 is performed at the front face 314*a* of the main body 314, the efficiency of the exchange operation is improved and the processing time is reduced.

(Embodiment 9)

A ninth embodiment of the invention will be explained with reference to FIGS. 29 to 33.

Figure 29:
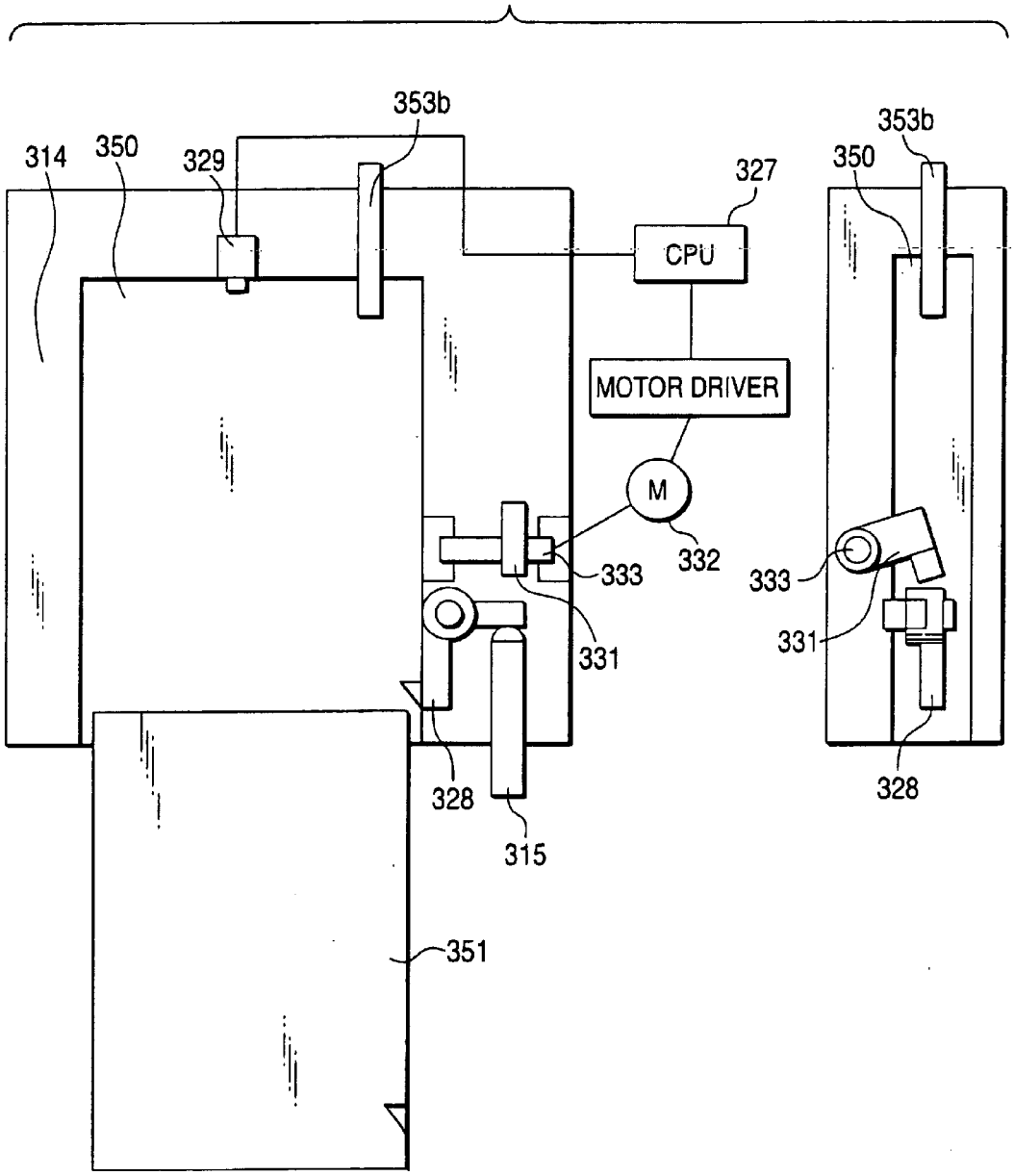
FIG. 29 is an explanatory diagram, showing the ink-jet recording device according to a ninth embodiment of the invention, wherein a control mechanism has removed the waste ink reservoir.
Figure 30:
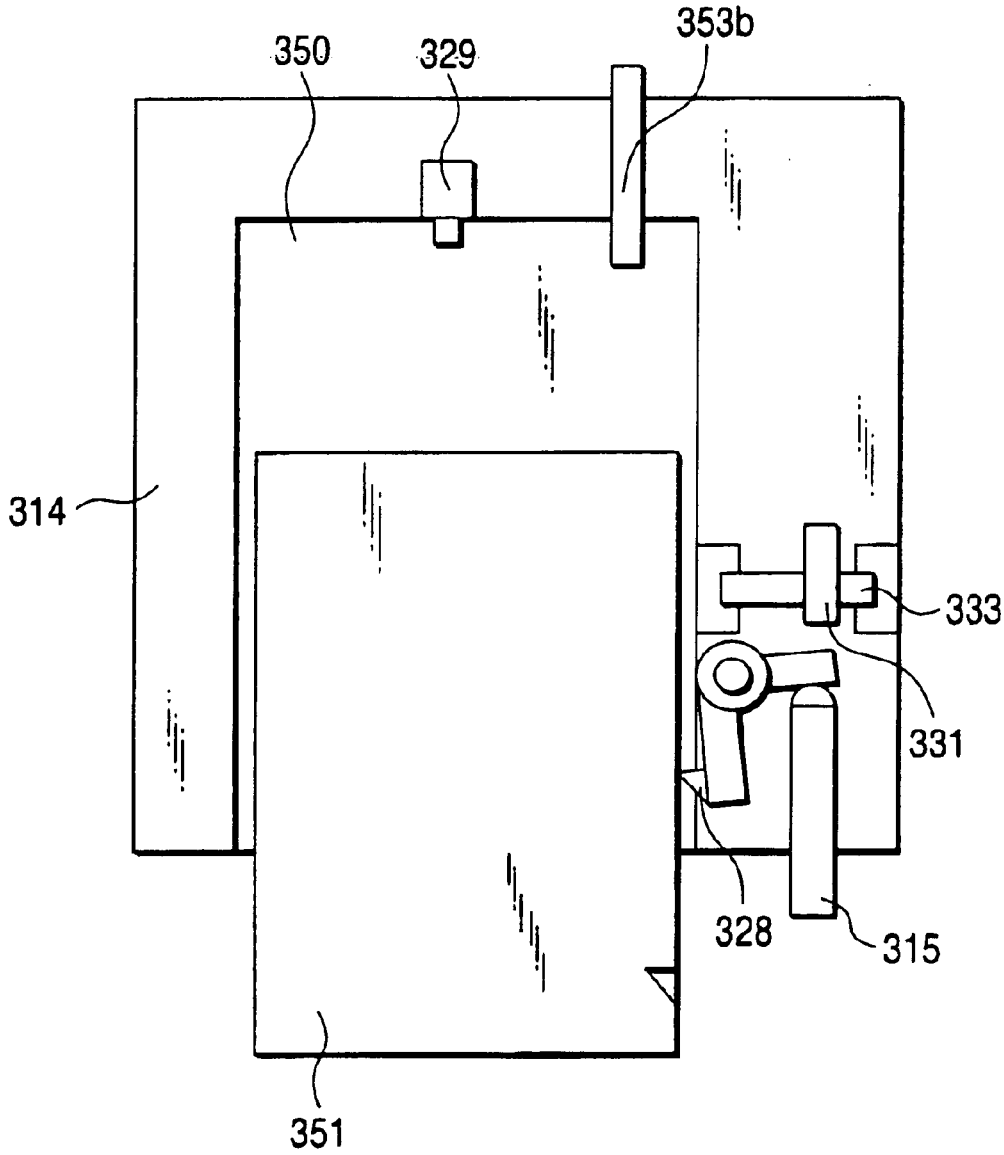
FIG. 30 is an explanatory diagram, showing the ink-jet recording device according to the ninth embodiment, wherein the control mechanism is loading the waste ink reservoir.
Figure 31:
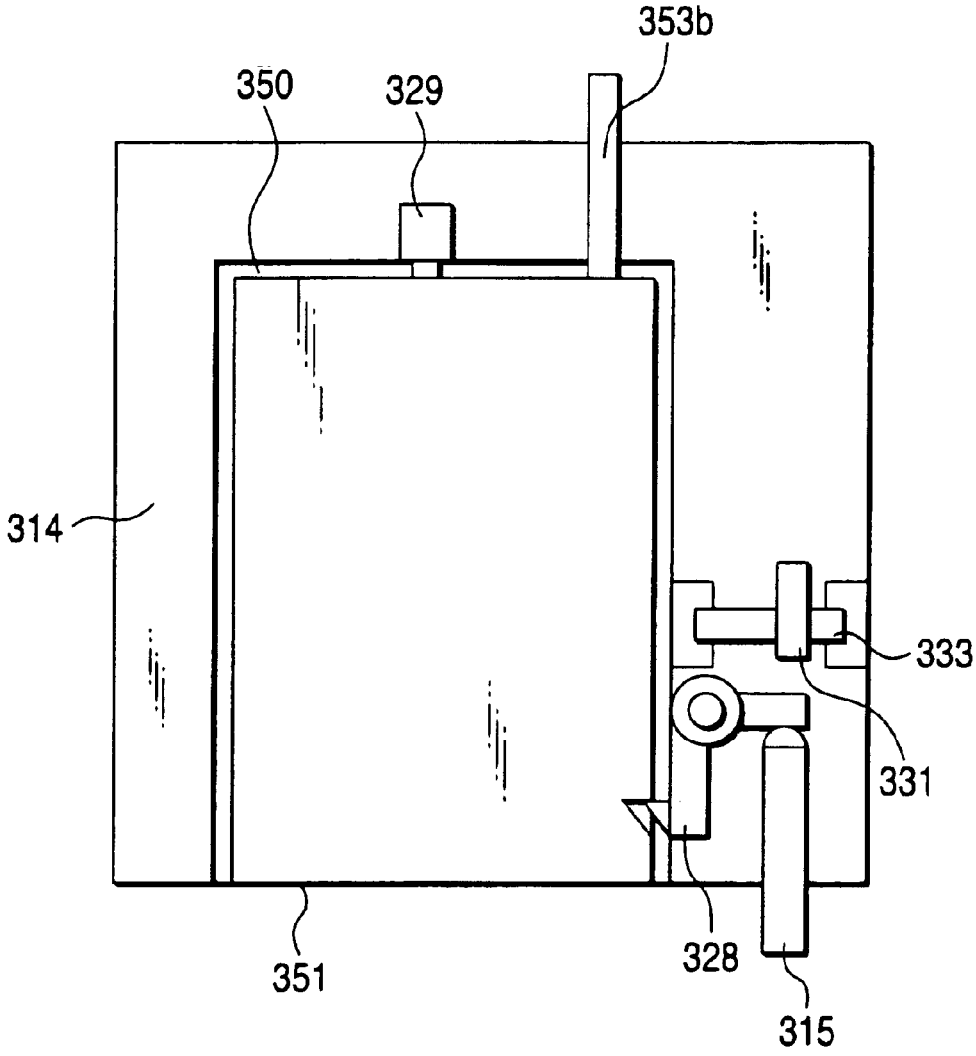
FIG. 31 is an explanatory diagram, showing the ink-jet recording device according to the ninth embodiment, wherein the control mechanism has loaded the waste ink reservoir.
Figure 32:
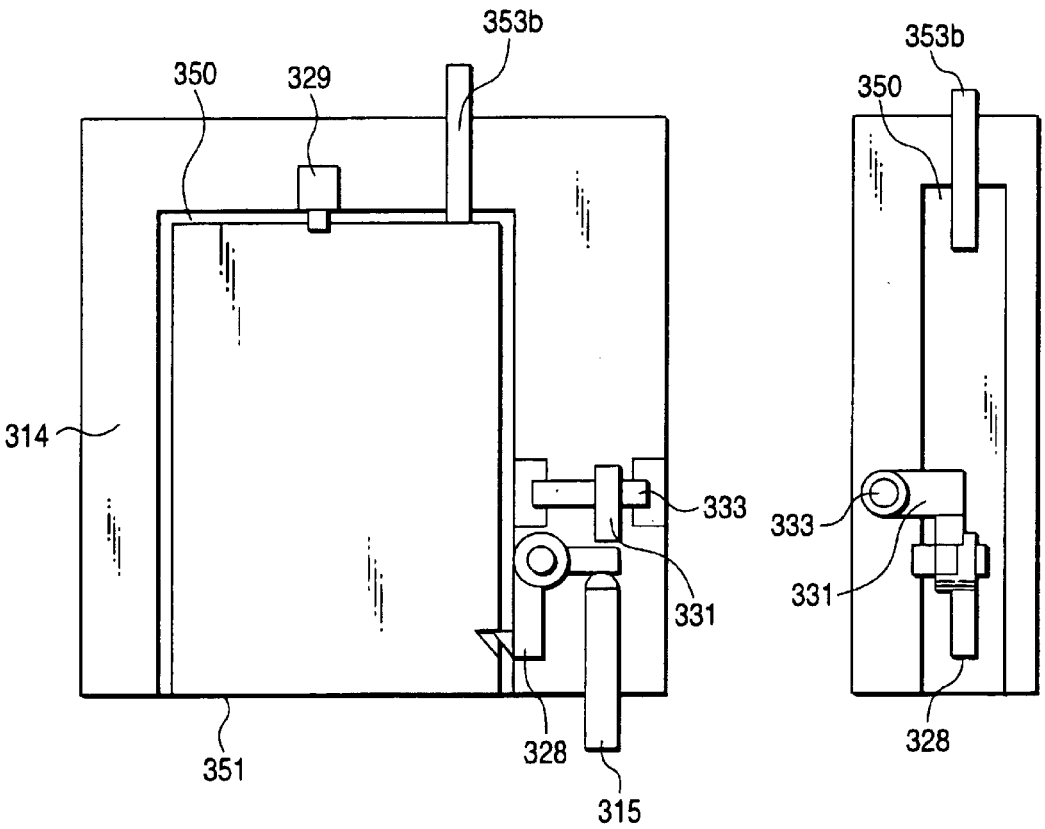
FIG. 32 is an explanatory diagram, showing the ink-jet recording device according to the ninth embodiment, wherein the control mechanism prevents the removal of the waste ink reservoir.
Figure 33:
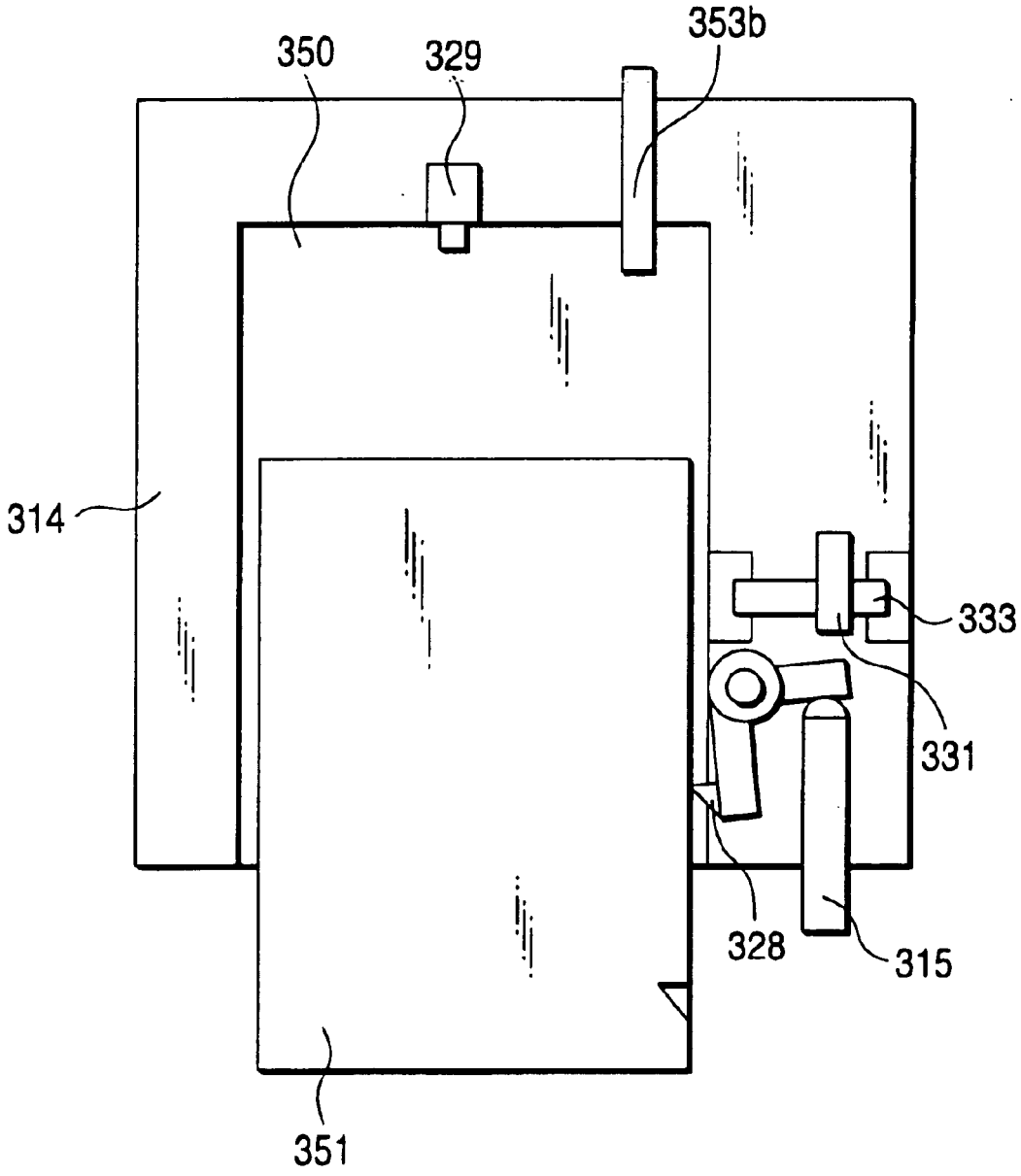
FIG. 33 is an explanatory diagram, showing the ink-jet recording device according to the ninth embodiment, wherein the control mechanism enables the removal of the waste ink reservoir.

FIG. 29 is an explanatory diagram, showing the ink-jet recording device according to ninth embodiment of the invention, wherein a control mechanism has removed the waste ink reservoir. FIG. 30 is an explanatory diagram, showing the ink-jet recording device according to the ninth embodiment of the invention, wherein the control mechanism is loading the waste ink reservoir. FIG. 31 is an explanatory diagram, showing the ink-jet recording device according to the ninth embodiment, wherein the control mechanism has loaded the waste ink reservoir. FIG. 32 is an explanatory diagram, showing the ink-jet recording device according to the ninth embodiment, wherein the control mechanism disables the removal of the waste ink reservoir. FIG. 33 is an explanatory diagram, showing the ink-jet recording device according to the ninth embodiment, wherein the control mechanism enables the removal of the waste ink reservoir.

It is not appropriate for the waste ink reservoir 351 is removed in a period during which ink is flowing from the recording head 318 to the waste ink reservoir 351, such as a period during a recording standby operation (an operation during which, when the ink cartridge 312 is mounted on the recording head 318 the first time, the pump 354 sucks ink from the recording head 318 in order to load ink into the recording head 318), or a period for a head function recovery operation (an operation during which the pump 354 removes residual ink or dust from the recording head 318 to recover the ink ejection function, e.g., the operation wherein the pump 354 sucks ink through the nozzles of the recording head 318 under negative pressure, and removes residual ink to clean the recording head), i.e., in a period (a removal inhibited period) during which waste ink removed from the recording head 318 would leak inside the device by removing the waste ink reservoir 351 from the waste ink reservoir loading unit 350.

The removal inhibited period is not limited to the recording standby period and the head function recovery period, but also includes a period other than these. That is, the removal inhibited period is a period during which, since ink is flowing from the reading head 318 to the waste ink reservoir 351, the waste ink may leak inside the device due to the removal of the waste ink reservoir 351. Further, the removal inhibited period does not include all the periods during which removal of the waste ink reservoir may cause waste ink to leak inside the device, and need only include at least one of these periods. Therefore, the removal inhibited period may be either the recording standby period or the head function recovery period.

As shown in FIGS. 29 to 33 for the ink-jet recording device of this embodiment, a controller 327 (removal inhibition unit) 327 is provided to disable the removal of the waste ink reservoir 351 during a removal inhibited period. With this controller 327, the waste ink is prevented from leaking inside the device when the waste ink reservoir 351 is detached externally through direct access.

As shown in FIGS. 6 to 10, the ink-jet recording device includes: a holding hook (holding member) 328 which engages the side of the waste ink reservoir 351 loaded in the waste ink reservoir loading unit 350 and holds the waste ink reservoir 351; the eject button 315 which displaces the holding hook 328 and disengages the holding hook 328 from the waste ink reservoir 351 so that the waste ink reservoir 351 is projected from the waste ink reservoir loading unit 350 and can be removed; and a detection switch 329 which detects the loading of the waste ink reservoir 351 into the waste ink reservoir loading unit 350.

Furthermore, in the ink-jet recording device, a lock lever (removal prevention member) 331 corresponding to the holding hook 328 is fitted around a lock shaft 333 that is rotated by a motor 332. As the lock shaft 333 is rotated, the lock lever 331 is displaced between a first position and a second position. At the first position, the displaceable range of the holding hook 328 is limited to prevent the projection of the waste ink reservoir 351 by the eject button 315, and at a second position, the displaceable range of the holding hook 328 is reserved to allow the projection of the waste ink reservoir 351 by the eject button 315.

Furthermore, when the controller rotates the lock shaft 333 through a driver, during a removal inhibited period the controller 327 holds the lock lever 331 at the first position, or during another period, holds the lock lever 331 at the second position.

The operation of the thus arranged ink-jet recording device will now be described.

The lock shaft 333 is rotated by the controller 327 until the lock lever 331 is displaced to the second position, and as shown in FIG. 29, the waste ink reservoir 351 is inserted into the waste ink reservoir loading unit 350 provided for the main body 314. Then, as shown in FIG. 30, the holding hook 328, which is urged clockwise by a spring (not shown), is pivoted counterclockwise. And as shown FIG. 31, when the waste ink reservoir 351 is pushed into the waste ink reservoir loading unit 350 until it engages the waste ink transportation tube 353*b*, the holding hook 328 is fitted into the groove formed in the side of the waste ink reservoir 351 and securely holds the waste ink reservoir 351.

Thereafter, during a removal inhibited period, such as a recording standby period or a head function recovery period, the lock lever 331 fitted around the lock shaft 333 is displaced from the second position in FIG. 31 to the first position in FIG. 32 as the lock shaft 333 is rotated by the motor 332 under the control of the controller 327. Since at the first position the displaceable range of the holding hook 328 is limited by the lock lever 331, the waste ink reservoir 351 con not be projected even by manipulating the eject button 315.

In a period other than a removal inhibited period, the lock shaft 333 is rotated by the controller 327 and the lock lever 331 is displaced to the second position, so that the displaceable range required for the rotation of the holding hook 328 is obtained as shown in FIG. 33. Therefore, the holding hook 328 is rotated counterclockwise by depressing the eject button 315 and is disengaged from the groove formed in the side of the waste ink reservoir 351, and as a result, the waste ink reservoir 351 is projected and can be removed.

According to this embodiment, during the removal inhibited period, the removal of the waste ink reservoir 351 is disabled by the controller 327. Therefore, ink can be prevented from leaking inside the device when the waste ink reservoir 351 is externally detached through direct access.

(Embodiment 10)

Figure 34:
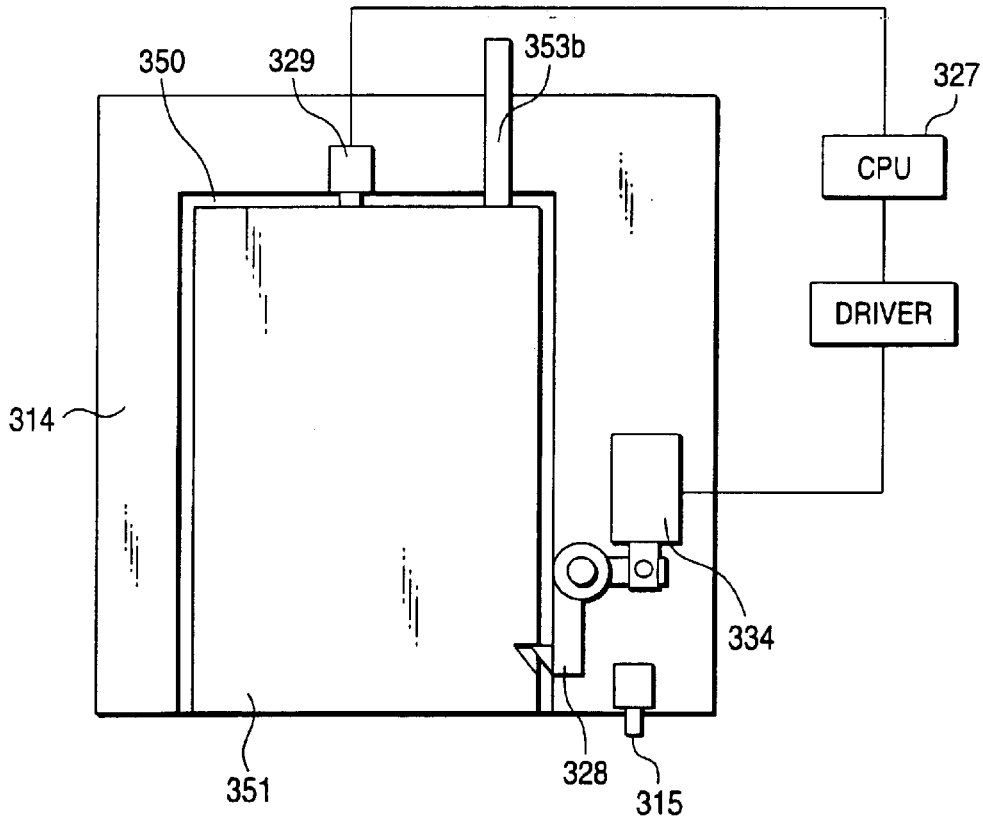
FIG. 34 is an explanatory diagram, showing an ink-jet recording device according to a tenth embodiment of the present invention, wherein a control mechanism prevents the removal of a waste ink reservoir.
Figure 35:
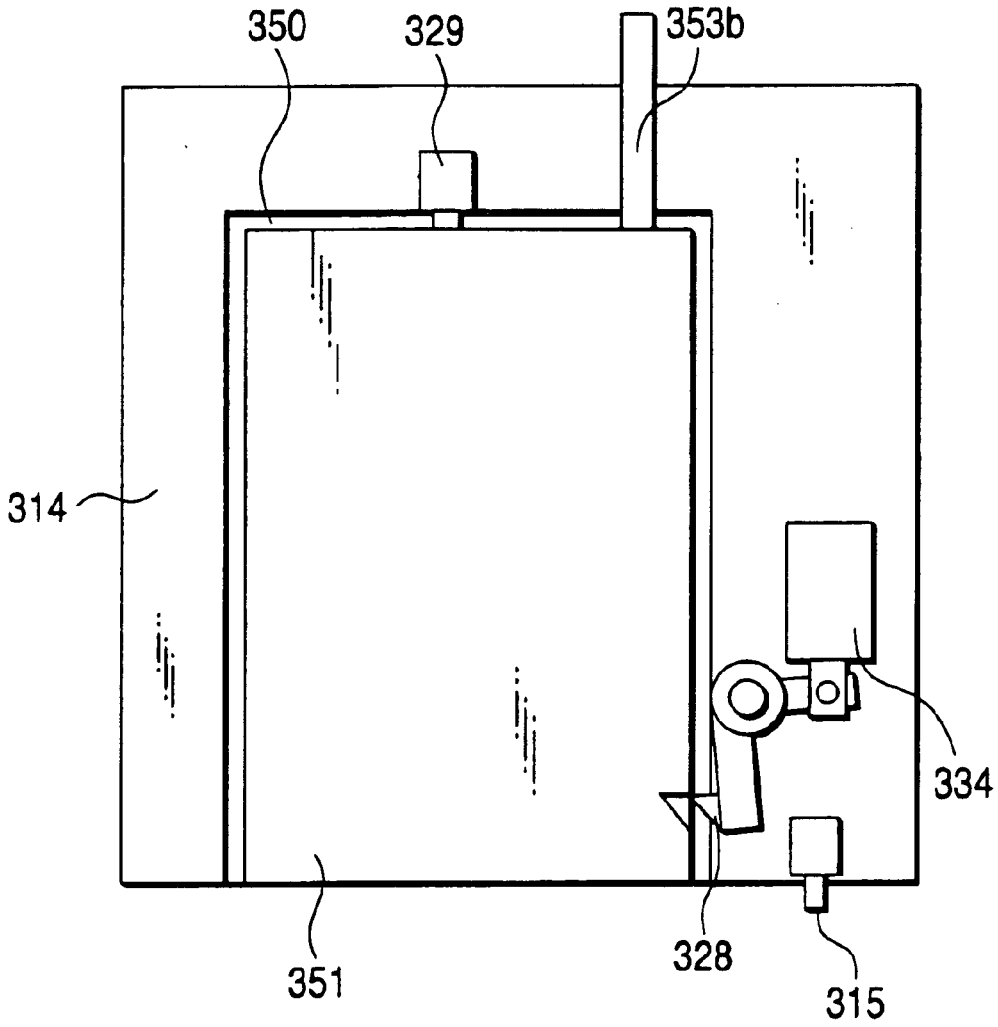
FIG. 35 is an explanatory diagram, showing the ink-jet recording device according to the tenth embodiment of the present invention, wherein the control mechanism enables the removal of the waste ink reservoir.
Figure 36:
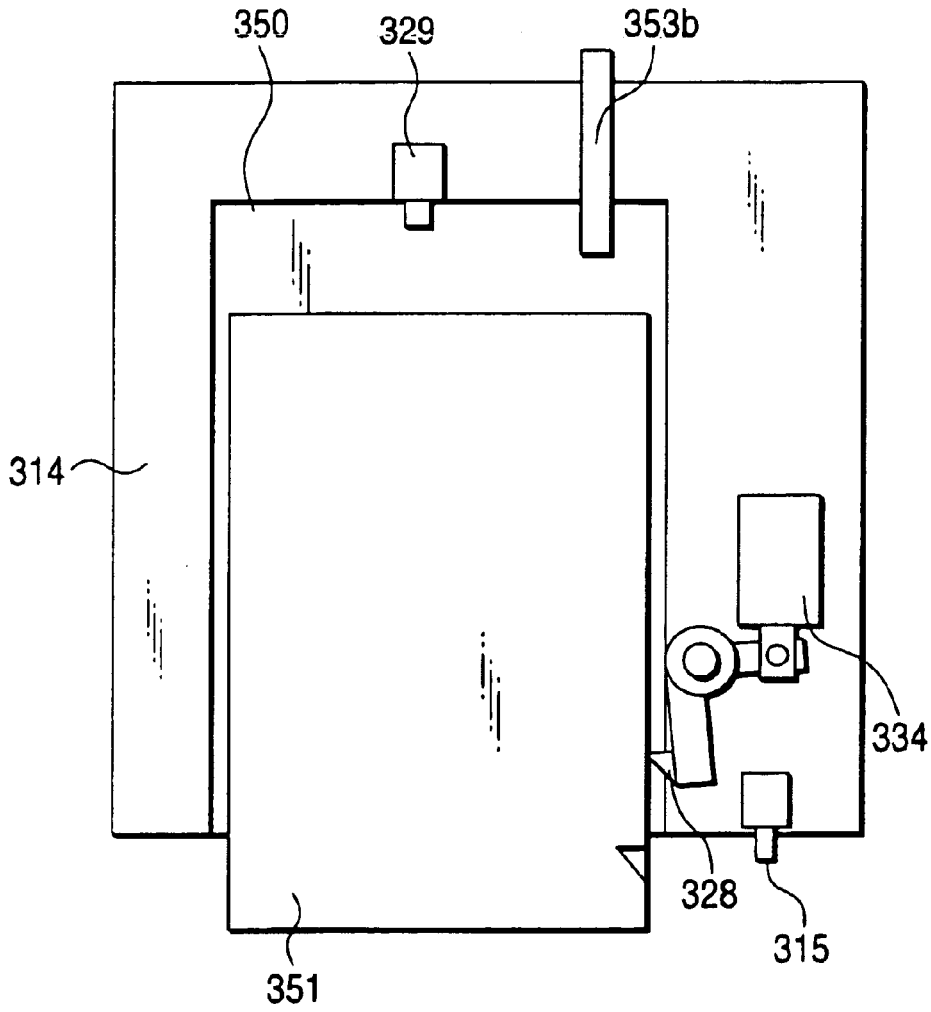
FIG. 36 is an explanatory diagram, showing the ink-jet recording device according to the tenth embodiment of the present invention, wherein the control mechanism has projected the waste ink reservoir.

FIG. 34 is an explanatory diagram, showing an ink-jet recording device according to a tenth embodiment of the present invention, wherein a control mechanism disables the removal of a waste ink reservoir. FIG. 35 is an explanatory diagram, showing the ink-jet recording device according to the tenth embodiment, wherein the control mechanism enables the removal of the waste ink reservoir. FIG. 36 is an explanatory diagram, showing the ink-jet recording device according to the tenth embodiment, wherein the waste ink reservoir has been projected by the control mechanism.

In each of the embodiments 10 to 12, the exterior and the internal configuration of the ink-jet recording device are substantially the same as those in the ninth embodiment.

In this embodiment, a controller 327 is provided that disables the removal of a waste ink reservoir 351 during the removal inhibited period, and prevents ink from leaking inside the device due to the removal of the waste ink reservoir 351, which can be externally detached through direct access.

That is, as shown in FIGS. 34 to 36, the ink-jet recording device includes: an actuator (holding member driving unit) 334 for displacing a holding hook 328 between an engagement position for engaging the waste ink reservoir 351 and a disengagement position; an eject button 315 which allows the actuator 334 to displace the holding hook 328 to the disengagement position, thereby permitting the waste ink reservoir 351 to be projected and removed from a waste ink reservoir loading unit 350; and the controller 327, which inhibits the driving of the actuator 334 by the eject button 315 during a removal inhibited period, and permits the actuator 334 to be driven during another period.

The operation of the thus arranged ink-jet recording device will now be described.

When the waste ink reservoir 351 is inserted into the waste ink reservoir loading unit 350, the holding hook 328, urged clockwise by a spring (not shown), is fitted into the groove formed in the side of the waste ink reservoir 351, and the engagement of the waste ink reservoir 351 is maintained (FIG. 34).

Thereafter, during a removal inhibited period, such as a recording standby period or a head function recovery period, the controller 327 inhibits the driving of the actuator, even by the depression of the eject button 315. Therefore, the waste ink reservoir 351 is not projected.

During a period other than a removal inhibited period, as shown in FIG. 35, upon the depression of the eject button 315, the controller detects that it is not in a removal inhibited period and drives the actuator 334. Then, the holding hook 328 is rotated counterclockwise and is disengaged from the groove formed in the side of the waste ink reservoir 351. Thus, as shown FIG. 36, the waste ink reservoir 351 is projected and can be removed.

As described above, according to the present invention, since during a removal inhibited period, the controller 327 prevents the removal of the waste ink reservoir 351, ink can be prevented from leaking inside the device due to the removal of the waste ink reservoir 351, which can be directly detached through external access.

(Embodiment 11)

Figure 37A:
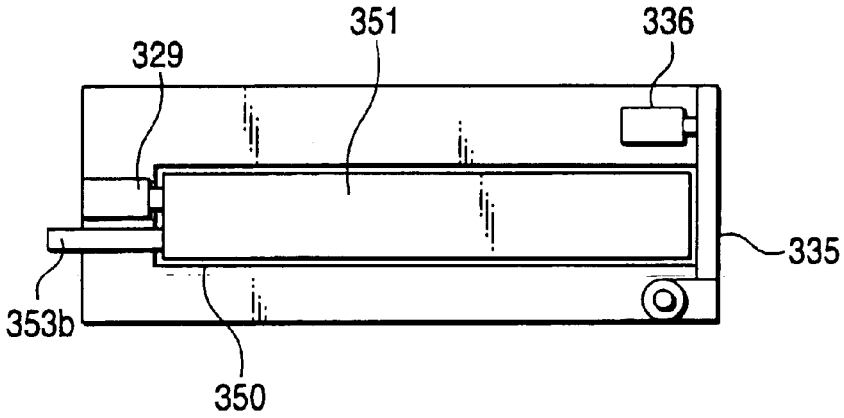
FIG. 37 is an explanatory diagram, showing an ink-jet recording device according to an eleventh embodiment of the present invention, wherein a control mechanism detects the start of the removal of a waste ink reservoir.
Figure 37B:
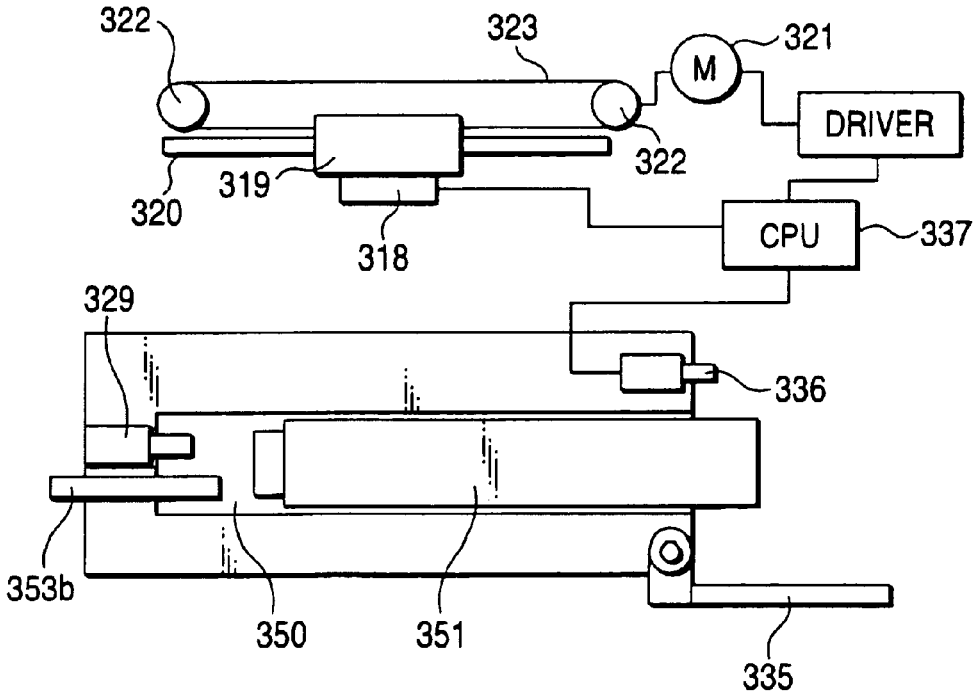

FIGS. 37A and 37B are explanatory diagrams showing an ink-jet recording device according to a eleventh embodiment of the present invention, wherein a control mechanism detects the start of the removal of a waste ink reservoir. In FIG. 37A, the removal of the waste ink reservoir has not yet started, and in FIG. 37B, the removal of the waste ink reservoir has started. To simplify the drawings, a control system is shown only in FIG. 37B.

As shown in FIGS. 37A and 37B, a door 335 provided at the front face of the waste ink reservoir 350 can be opened and closed while a waste ink reservoir 351 is loaded into a waste ink reservoir loading unit 350.

Further, an operation detector 336 is provided for detecting the opening or closing of the door 345, and for determining whether the removal of the waste ink reservoir 351 has started when the door 335 is opened.

In addition, a controller (removal control unit) 337 is provided that, when the operation detector 336 detects that the removal of the waste ink reservoir 351 has started during a removal inhibited period for the waste ink reservoir 351, i.e., the opening or closing of the door 335 is detected, moves the device to the recording standby state, and can remove the waste ink reservoir 351.

According to the ink-jet recording device, when the door 335 is opened to exchange the waste ink reservoir 351 during a removal inhibited period (FIG. 37B), the operation is detected by the operation detector 336. Thereafter, the controller 337 quickly terminates a recording operation or a head function recovery operation, and shifts the device to the recording standby state.

Therefore, when the waste ink reservoir 351 is removed during the removal inhibited period, the leakage of ink inside the device can be prevented.

The door 335 may cover the waste ink reservoir 351 and the ink cartridge 312. In this case, the door 335 is formed so that it fits the height of the main body 314, regardless of whether it is fully or partially opened, or closed. With this configuration, the door 335 can be comparatively freely opened and closed regardless of the peripheral state (how objects, such as documents, books and AV decks are disposed), and a usable ink-jet recording device can be implemented. Especially since an AV deck usually has legs, while taking the stacking of this deck into account, the size of the cover 335 that is opened or closed may exceed the height of the main body by the length of the legs.

In addition to the door 335, a lid for covering the ink cartridge 312 may be provided.

Further, a control member other than the door 335 can be employed so long as it can prevent the accessing of the ink cartridge 312 or the waste ink reservoir 351. Furthermore, the control member need not completely hide the ink cartridge 312 or the waste ink reservoir 351.

(Embodiment 12)

Figure 38:
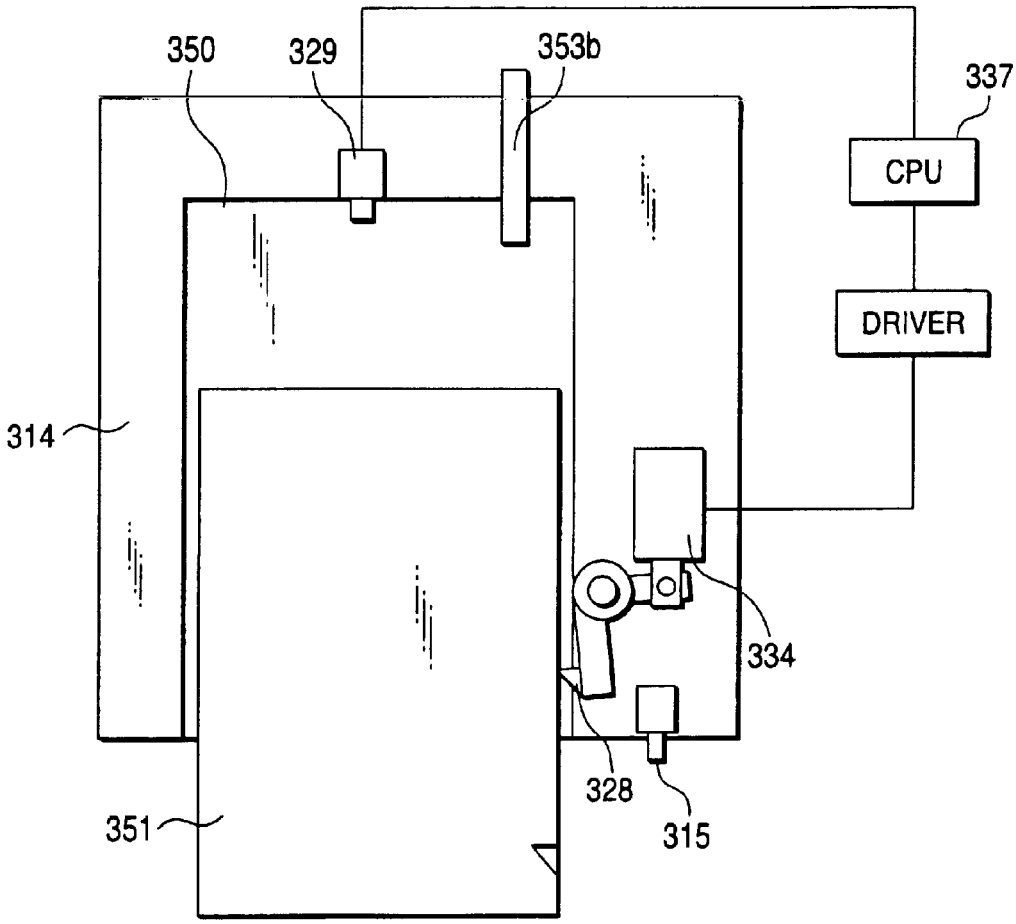
FIG. 38 is an explanatory diagram, showing an ink-jet recording device according to a twelfth embodiment of the present invention, wherein a control mechanism has removed the waste ink reservoir.
Figure 39:
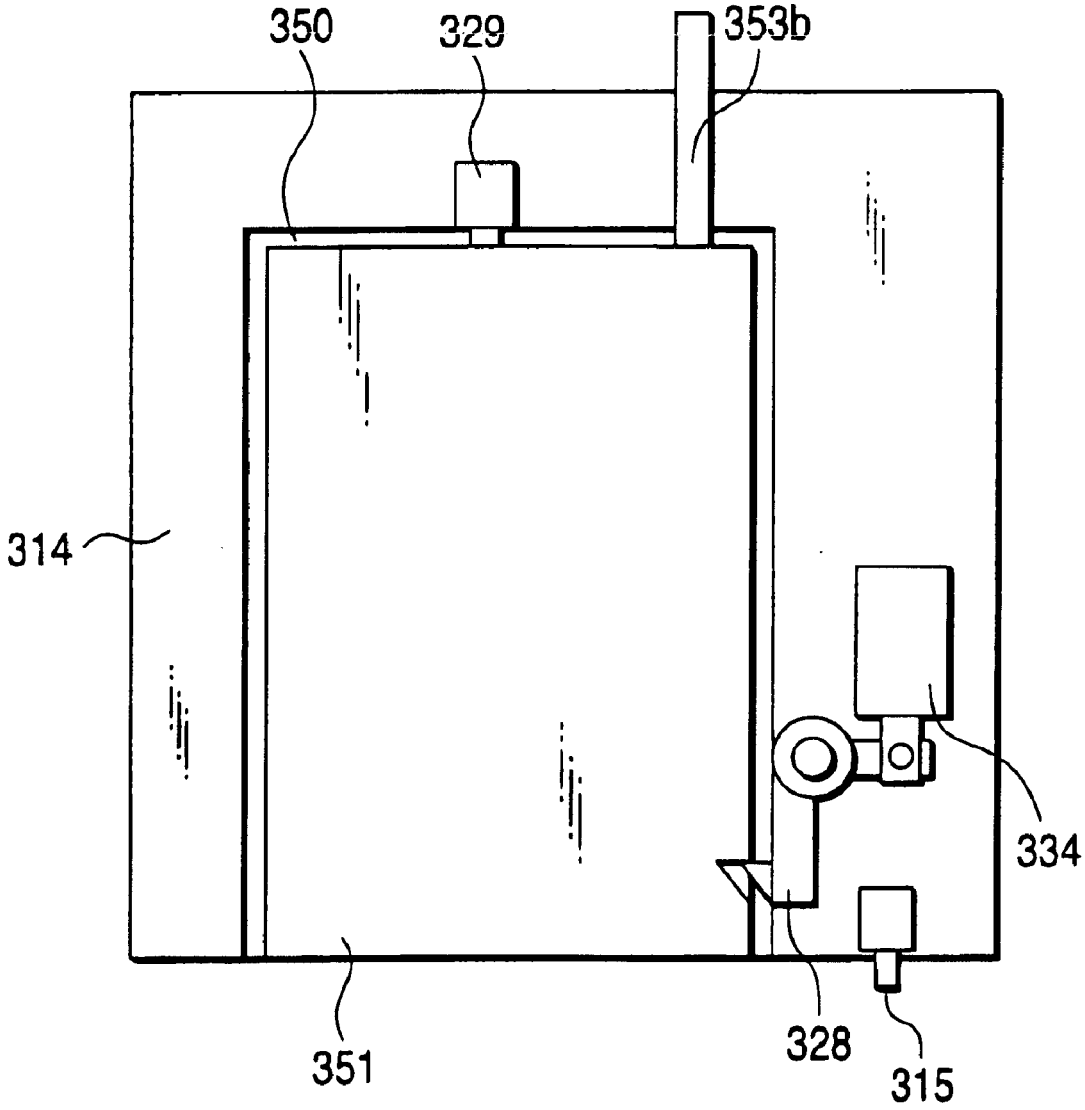
FIG. 39 is an explanatory diagram, showing the ink-jet recording device according to the twelfth embodiment of the present invention, wherein the control mechanism has loaded the waste ink reservoir.
Figure 40:
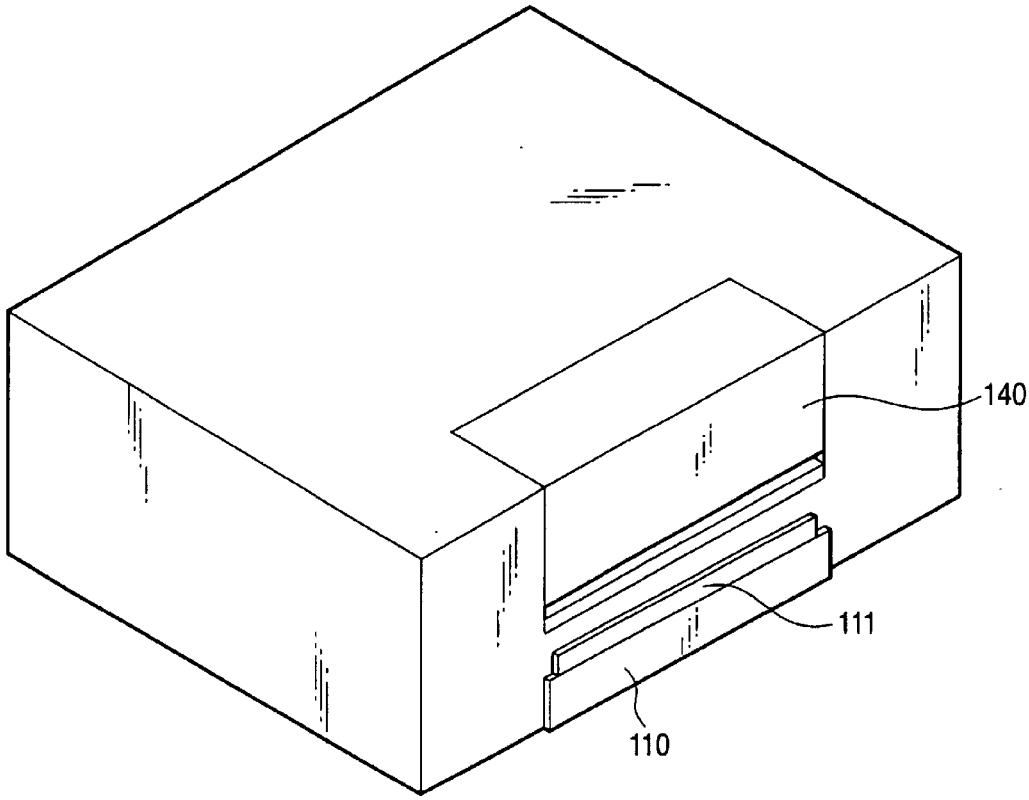
FIG. 40 is a perspective view of the exterior of an ink-jet recording device in the related art.
Figure 41:
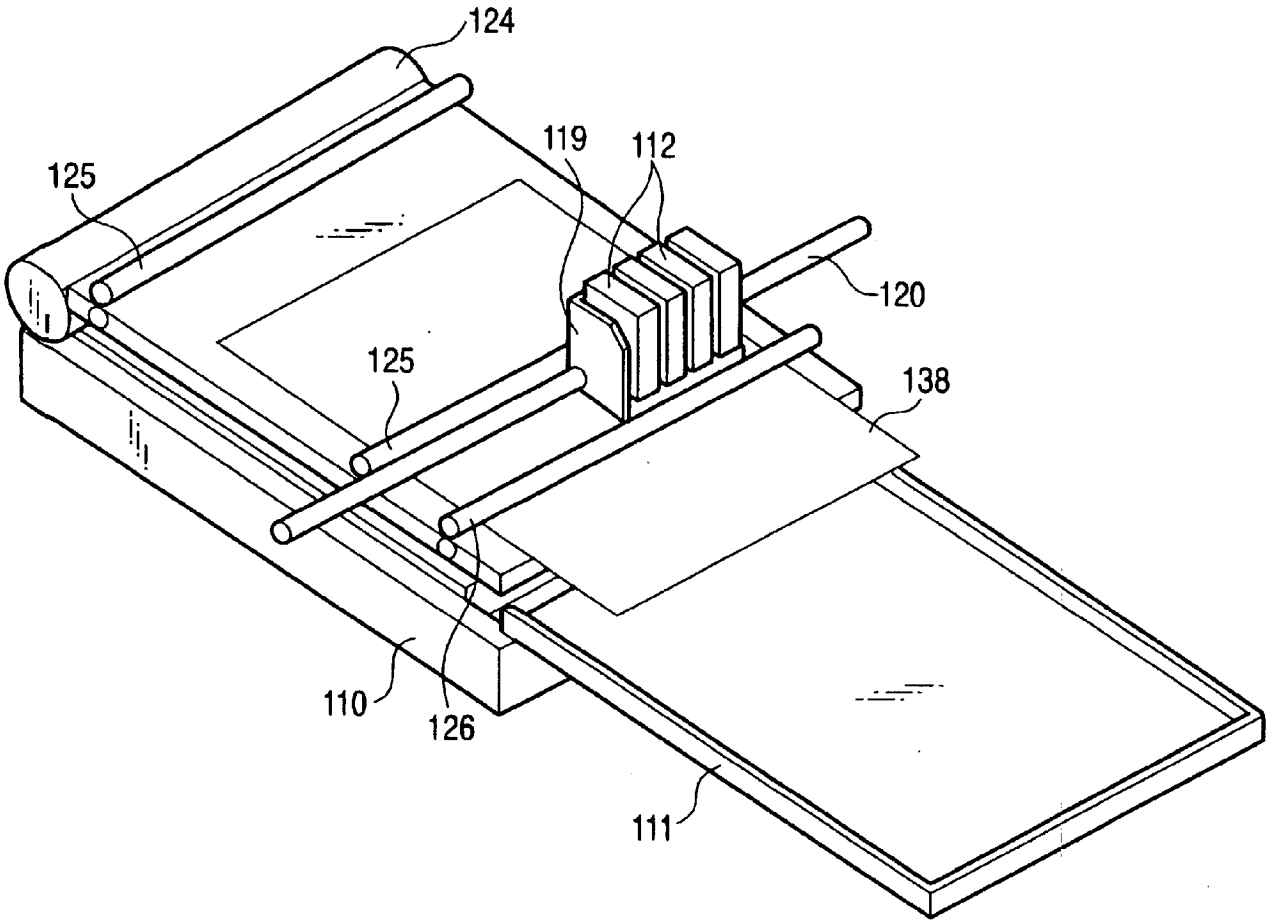
FIG. 41 is a schematic perspective view of the internal structure of the ink-jet recording device in FIG. 40.
Figure 42:
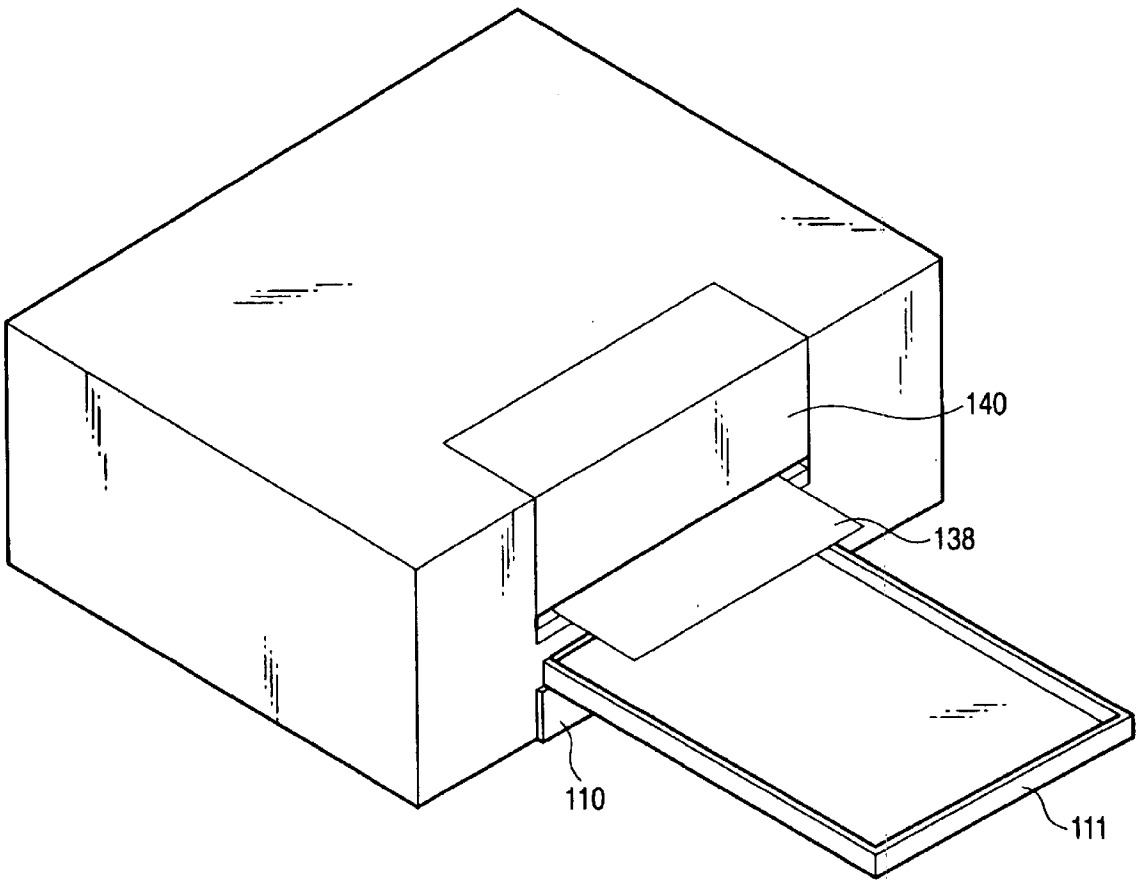
FIG. 42 is an exterior perspective view of the ink-jet recording device in FIG. 40 wherein a paper discharge tray has been pulled out.
Figure 43:
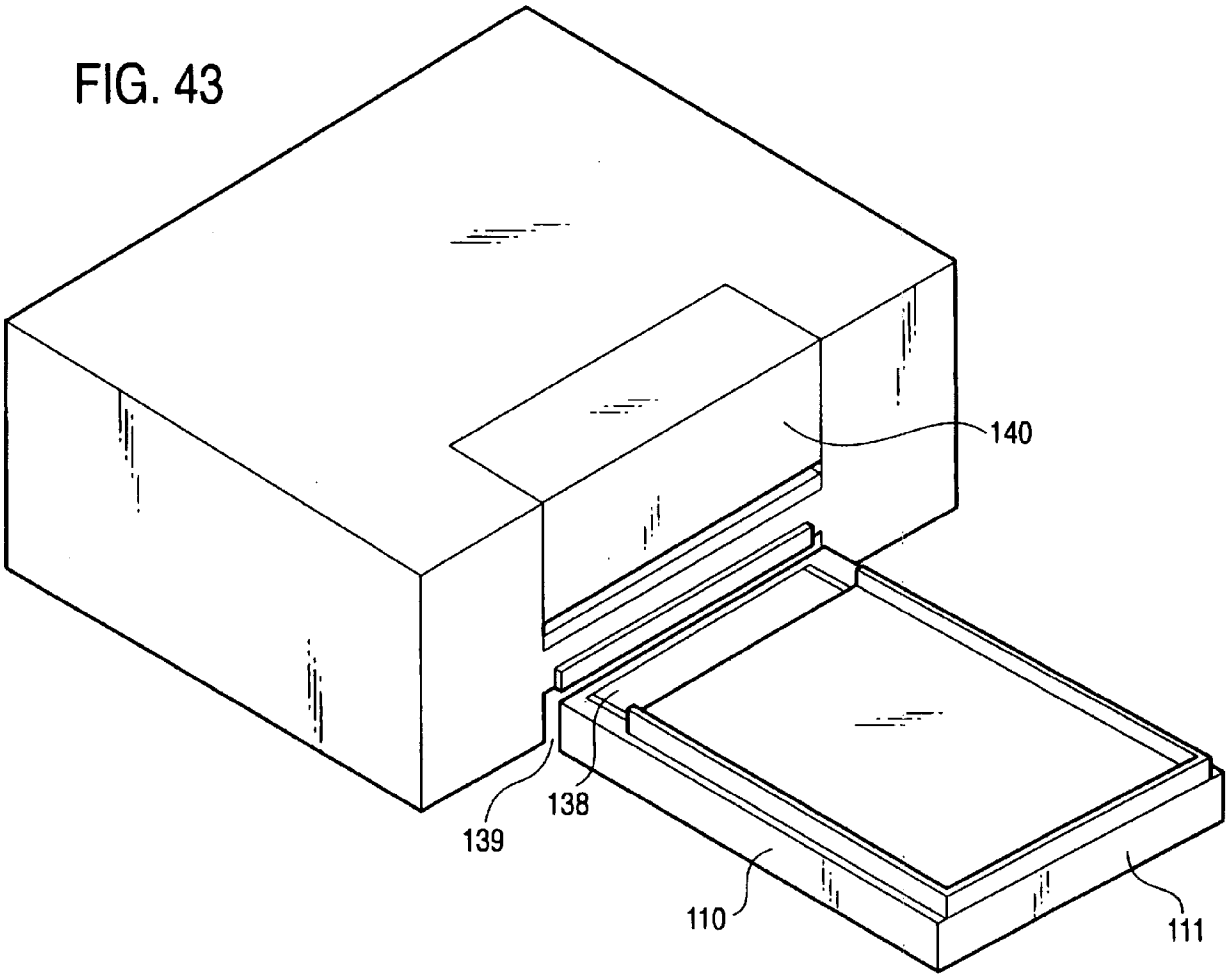
FIG. 43 is an exterior perspective view of the ink-jet recording device in FIG. 40 wherein a paper supply tray has been removed.
Figure 44:
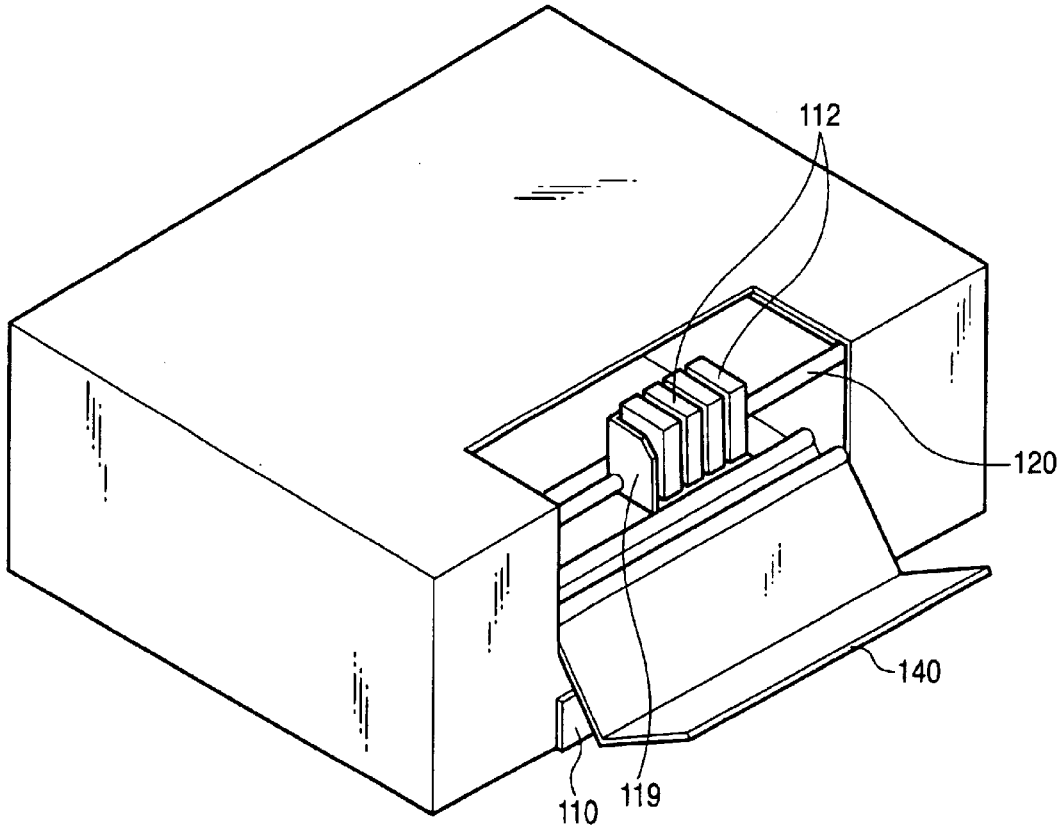
FIG. 44 is an exterior perspective view of the ink-jet recording device in FIG. 40 wherein a front cover has been opened.

FIG. 38 is an explanatory diagram, showing an ink-jet recording device according to a twelfth embodiment of the present invention, wherein a control mechanism has removed a waste ink reservoir. FIG. 39 is an explanatory diagram, showing the ink-jet recording device according to the twelfth embodiment of the present invention, wherein the control mechanism has loaded the waste ink reservoir.

As shown in FIGS. 38 and 39, the ink-jet recording device of this embodiment includes: a detection switch (removal detector) 329 for detecting the removal of a waste ink reservoir 351; and a controller 337 for shifting the device to the recording standby state when a detection switch 329 detects the removal of the waste ink reservoir 351 during a removal inhibited period.

With this configuration, when the waste ink reservoir 351 is removed during a removal inhibited period, the detection switch 329 detects this removal. Thereafter, the controller 337 immediately terminates a recording operation or a head function recovery operation, and shifts the device to the recording standby state.

Therefore, when the waste ink reservoir 351 is removed during the removal inhibited period the leakage of ink inside the device can be prevented.

According to the ninth to twelfth embodiments of the present invention, the eject button 315 is used as the switching unit; however, any switching unit can be employed so long as it permits the removal of the waste ink reservoir 351. For example, an eject button on a remote controller or a command provided for a driver installed in a personal computer may be used as a switching unit.

As described above, according to the present invention, since a removal inhibition unit disables removal of an ink supply member during a removal inhibited period, or since a removal unit shifts an ink-jet recording device to a recording standby state when an ink supply unit is removed, air bubbles can be prevented from entering an ink flow path due to the removal of an ink supply member that can be directly detachable, externally.

Further, according to the present invention, since the waste ink reservoir is replaceably loaded inward of a predetermined face of the main body, the volume of the waste ink container and the size of the device can be reduced.

When the waste ink container and ink supply member assembly can be replaceably loaded, the volume of the waste ink reservoir and the size of the device can be reduced. Further, since the waste ink reservoir and the ink supply member can both be exchanged at the same time, the operation is simplified.

When the waste ink reservoir and the medium supply member assembly can be replaceably loaded, the volume of the waste ink reservoir and the size of the device can be reduced. Further, since the waste ink reservoir and the medium supply member can be exchanged at the same time, the operation is simplified.

When the replenishment of the recording media and the refilling of ink supply members are disabled, the waste ink container, the medium supply member and the ink supply member are all exchanged at the same time. Therefore, the volume of the ink container and the size of the device can be reduced.

Still further, according to the present invention, during a removal inhibited period, the removal inhibition unit prevents the removal of the ink supply member, or the removal control unit shifts the device to the recording standby state. Therefore, in effect, ink can be prevented from leaking inside the device due to the removal of the waste ink storage unit, which can be detached externally through direct access.

What is claimed is:

1. An ink-jet recording device comprising:

a medium feeding unit arranged inward from a first face of a main body for feeding a recording medium;

a medium ejection unit arranged inward from the first face for ejecting the recording medium after recording;

an ink supply member loading unit arranged inward from the first face for detachably loading an ink supply member wherein ink used for recording is retained;

an operation detector for detecting a start of an ink supply member removal operation; and a removal controller for, when the operation detector has detected the start of the ink supply member removal operation during a removal inhibited period for the ink supply member, shifting the ink-jet recording device to the recording standby state to enable the removal of the ink supply member.

2. The ink-jet recording device according to claim 1, further comprising:

a door provided on the front face of the ink supply member loading unit while the ink supply member is loaded in the ink supply member loading unit;

wherein the operation detector detects the opening and closing of a door, wherein, when the operation detector has detected the opening of the door, the removal controller ascertains the ink supply member removal operation has begun.

3. The ink-jet recording device according to claim 1, wherein the removal inhibited period includes at the least one of a recording period and a head function recovery period.

4. The ink-jet recording device according to claim 1, wherein an ink supply member loading unit loads a plurality of the ink supply members for multiple colors wherein the removal controller controls the removal of each of the ink supply members.

5. An ink-jet recording device according to claim 1, further comprising:

a notification unit for reporting one of states where the ink supply members are loaded into the ink supply member loading unit and where the ink supply members are not loaded.

6. An ink-jet recording device comprising:

a medium feeding unit arranged inward from a first face of a main body for feeding a recording medium;

a medium ejection unit arranged inward from the first face for ejecting the recording medium after recording;

an ink supply member loading unit arranged inward from the first for detachably loading an ink supply member wherein ink used for recording is retained;

a removal detector for detecting removal of the ink supply member; and a removal controller for, when the removal detector detects that the ink supply member has been removed during a removal inhibited period for the ink supply member, shifting the ink-jet recording device to the recording standby state.

7. The ink-jet recording device according to claim 6, wherein the removal inhibited period includes at the least one of a recording period and a head function recovery period.

8. The ink-jet recording device according to claim 6, wherein an ink supply member loading unit loads a plurality of the ink supply members for multiple colors wherein the removal controller controls the removal of each of the ink supply members.

9. An ink-jet recording device according to claim 6, further comprising:

a notification unit for reporting one of states where the ink supply members are loaded into the ink supply member loading unit and where the ink supply members are not loaded.

* * * * *